US012168846B2

(12) United States Patent
Jung et al.

(10) Patent No.: US 12,168,846 B2
(45) Date of Patent: Dec. 17, 2024

(54) LAUNDRY TREATING APPARATUS

(71) Applicant: LG Electronics Inc., Seoul (KR)

(72) Inventors: Sungwoon Jung, Seoul (KR); Hyehyun Sim, Seoul (KR); Hunjun Jang, Seoul (KR)

(73) Assignee: LG Electronics Inc., Seoul (KR)

( * ) Notice: Subject to any disclaimer, the term of this patent is extended or adjusted under 35 U.S.C. 154(b) by 340 days.

(21) Appl. No.: 17/497,288

(22) Filed: Oct. 8, 2021

(65) Prior Publication Data

US 2022/0112648 A1 Apr. 14, 2022

(30) Foreign Application Priority Data

Oct. 8, 2020 (KR) ..... 10-2020-0130147

(51) Int. Cl.

| | |
|---|---|
| ***D06F 39/02*** | (2006.01) |
| ***D06F 23/02*** | (2006.01) |
| ***D06F 39/06*** | (2006.01) |
| ***D06F 39/08*** | (2006.01) |
| ***D06F 39/12*** | (2006.01) |

(52) U.S. Cl.

CPC ..... *D06F 39/028* (2013.01); *D06F 23/025* (2013.01); *D06F 39/06* (2013.01); *D06F 39/088* (2013.01); *D06F 39/12* (2013.01)

(58) Field of Classification Search

CPC ..... D06F 39/028

See application file for complete search history.

(56) References Cited

U.S. PATENT DOCUMENTS

| | | | |
|---|---|---|---|
| 2013/0180293 | A1 | 7/2013 | Huerth et al. |
| 2020/0291563 | A1 | 9/2020 | Pos et al. |

FOREIGN PATENT DOCUMENTS

| | | |
|---|---|---|
| CN | 109923258 | 6/2019 |
| CN | 109923259 | 6/2019 |
| DE | 102014220026 | 4/2016 |
| JP | 2002355494 | 12/2002 |
| KR | 20090089059 | 8/2009 |
| WO | WO 2019/068337 | 4/2019 |

OTHER PUBLICATIONS

Extended European Search Report in European Appln. No. 21201194.4, dated Feb. 24, 2022, 8 pages.

Office Action in Chinese Appln. No. 202111170571.6, dated Apr. 12, 2023, 11 pages (with English translation).

Office Action in European Appln. No. 21201194.4, dated Nov. 15, 2023, 5 pages.

*Primary Examiner* — Jason Y Ko

(74) *Attorney, Agent, or Firm* — Fish & Richardson P.C.

(57) ABSTRACT

A laundry treating apparatus includes a cabinet, a tub, a drum, and a detergent feeder. The detergent feeder includes a storage unit, a supply casing, and a water supply unit, where the storage unit is inserted into the cabinet through the detergent opening and includes therein a storage space for storing detergent therein. The supply casing accommodates the storage unit therein. The water supply unit is configured to supply water to the storage unit and includes a water supply portion for supplying water to the storage unit, a shower portion for supplying water into the supply casing by avoiding the storage unit, and a shower flow channel extending from the water supply portion and connected to the shower portion to deliver water from the water supply portion to the shower portion.

20 Claims, 14 Drawing Sheets

LAUNDRY TREATING APPARATUS

CROSS-REFERENCE TO RELATED APPLICATIONS

This application claims the benefit of Korean Patent Application No. 10-2020-0130147, filed on Oct. 8, 2020, which is hereby incorporated by reference as if fully set forth herein.

TECHNICAL FIELD

The present disclosure relates to a laundry treating apparatus, and to a laundry treating apparatus having a detergent feeder.

BACKGROUND

A laundry treating apparatus is an apparatus that puts clothes, bedding, and the like (hereinafter, referred to as laundry) into a drum to remove contamination from the laundry. The laundry treating apparatus may perform processes such as washing, rinsing, dehydration, drying, and the like. The laundry treating apparatuses may be classified into a top loading type laundry treating apparatus and a front loading type laundry treating apparatus based on a scheme of putting the laundry into the drum.

The laundry treating apparatus may include a cabinet forming an appearance of the laundry treating apparatus, a tub accommodated in the cabinet, a drum that is rotatably mounted inside the tub and into which the laundry is put, and a detergent feeder that feeds detergent into the drum.

When the drum is rotated by a motor while wash water is supplied to the laundry accommodated in the drum, dirt on the laundry may be removed by friction with the drum and the wash water.

The detergent feeder has a detergent supply function to enhance a washing effect. In this connection, the detergent refers to a substance that enhances the washing effect, such as fabric detergent, fabric softener, fabric bleach, and the like. Detergent in a powder form and detergent in a liquid form may be used.

Korean Patent Publication Application KR 10-2018-0090003 A1 discloses a detergent feeder included in a laundry treating apparatus. The laundry treating apparatus may be used as a storage unit of the detergent feeder is inserted or withdrawn by a user.

The storage unit may include a storage space where the detergent is stored therein. After storing the detergent in the storage unit, the user may use the laundry treating apparatus by inserting the storage unit into the cabinet of the laundry treating apparatus.

The detergent feeder may further include a water supply unit for supplying water to the storage unit and a supply casing in which the storage unit is accommodated, in addition to the storage unit. The detergent stored in the storage unit and the water discharged from the water supply unit may be provided to a bottom surface of the supply casing and be discharged to the outside.

That is, the detergent and the like may come into contact with the bottom surface of the supply casing, and when the detergent remains, it may be disadvantageous to cleanliness and hygiene of the detergent feeder. Furthermore, some of the detergent inside the storage unit may unintentionally leak to the bottom surface of the supply casing in a process of insertion and withdrawal of the storage unit, so that washing of the supply casing is an important task.

In addition, various components in addition to the detergent feeder may be disposed inside the laundry treating apparatus. Therefore, it is an important task in the art to develop a detergent feeder that may minimize an increase in volume and efficiently supply detergent while securing sufficient capacity of a storage space within a limited space.

SUMMARY

Embodiments of the present disclosure are intended to provide a laundry treating apparatus that may effectively improve cleanliness and hygiene of a detergent feeder by effectively washing an interior of a supply casing.

In addition, embodiments of the present disclosure are intended to provide a laundry treating apparatus in which operation of a shower portion for washing a supply casing and operation of a water supply portion for supplying water to a storage unit may be made together through one water supply valve.

In addition, embodiments of the present disclosure are intended to provide a laundry treating apparatus having a structure that may efficiently supply detergent with excellent space utilization through optimal arrangement of components.

In a laundry treating apparatus according to one embodiment of the present disclosure, water may be supplied from an external water source to a water supply unit through a water supply valve and a water supply hose. The water supply unit may include therein a water supply flow channel through which water may flow, and a water supply portion that receives water from the water supply flow channel and delivers water to a storage unit.

The water supply unit may further include a shower portion that receives water from the water supply portion. The shower portion receives water from the water supply portion through a shower flow channel and delivers water into a supply casing, so that, because a separate hose or water supply flow channel is not required, an efficient structure may be realized.

In addition, because the water supply portion and the shower portion are of a structure that receives water from one water supply valve and one water supply hose, whether to operate the water supply portion and the shower portion may be determined together through one water supply valve, which is simple and effective.

In one example, at least a portion of the shower portion is located forwardly of the water supply portion, so that detergent that may leak from the storage unit in a process of insertion and withdrawal of the storage unit may be effectively washed.

Further, the storage unit may deliver at least a portion of detergent stored in a storage space to the water supply unit through a detergent hose, and the detergent hose may extend along an outer surface of the water supply unit. The water supply unit has hose accommodating grooves into which the detergent hoses are respectively inserted and accommodated on both sides of the water supply flow channel, so that a plurality of components may be effectively arranged.

According to an aspect of the present disclosure, provided is a laundry treating apparatus including a cabinet, a tub, a drum, and a detergent feeder. The cabinet has a detergent opening defined in a front surface thereof, the tub is disposed inside the cabinet, and accommodates water therein, and a drum is disposed rotatably inside the tub, and accommodates laundry therein.

The detergent feeder is disposed inside the cabinet, and supplies detergent into the tub. The detergent feeder includes a storage unit, a supply casing, and a water supply unit.

The storage unit is inserted into the cabinet through the detergent opening, and includes therein a storage space for storing detergent therein. The supply casing accommodates the storage unit therein, and the water supply unit is configured to supply water to the storage unit.

The water supply unit includes a water supply portion for supplying water to the storage unit, a shower portion for supplying water into the supply casing by avoiding the storage unit, and a shower flow channel extending from the water supply portion and connected to the shower portion to deliver water from the water supply portion to the shower portion.

In one implementation, the storage unit may include a detergent discharge portion for discharging detergent and water supplied through the water supply portion, and at least a portion of the shower portion may be located forwardly of the detergent discharge portion to supply water to a region located forwardly of the detergent discharge portion.

In one implementation, at least a portion of the shower portion may be located forwardly of the water supply portion to discharge water to a region located forwardly of the water supply portion.

In one implementation, the water supply unit may include a water supply flow channel disposed therein, wherein the water supply flow channel is connected to the water supply portion to flow water toward the water supply portion therethrough, the water supply portion may include a delivery flow channel disposed therein, wherein the delivery flow channel extends from the water supply flow channel toward the shower flow channel, and a portion of the delivery flow channel may be opened toward an interior of the water supply portion, so that at least a portion of water delivered from the water supply flow channel and flowing through the delivery flow channel is supplied into the water supply portion.

In one implementation, water supplied through the water supply flow channel may flow through the delivery flow channel defined between a pair of flow channel sidewalls crossing the water supply portion, and a portion of the pair of flow channel sidewalls may be open to communicate with the interior of the water supply portion.

In one implementation, the shower flow channel may extend from a front end of the water supply portion and be connected to the shower portion, and the delivery flow channel may extend forwardly from the water supply flow channel.

In one implementation, at least a portion of the shower flow channel may extend along a width direction of the water supply unit from the front end of the water supply portion.

In one implementation, the water supply unit may be configured to receive the flowing water through a water supply valve, and flow of water supplied to the water supply portion and to the shower portion may be regulated together based on opening and closing of the water supply valve.

In one implementation, in the water supply unit, water provided from a water supply hose where flow of water is regulated by the water supply valve may be delivered to the water supply portion through an internal water supply flow channel, and water delivered to the water supply portion may be delivered to the shower portion through the shower flow channel.

In one implementation, the water supply unit may be located above the storage unit, and the shower portion may be disposed on at least one of both ends of the water supply unit in a lateral direction to discharge water downward while avoiding the storage unit.

In one implementation, the supply casing may include a bottom surface and side walls respectively located on both sides of the bottom surface, and the side wall may include a shower water flow groove located below the shower portion, and open toward the shower portion, wherein water discharged from the shower portion is introduced into the shower water flow groove.

In one implementation, the storage unit may include a first space for storing first detergent therein and a second space for storing second detergent therein, wherein the first detergent is delivered to the water supply unit through a detergent hose, and the water supply unit may supply the first detergent and water to the second space through the water supply portion.

In one implementation, at least a portion of the detergent hose may extend along an outer surface of the water supply unit, and the water supply unit may include a hose accommodating groove defined in the outer surface thereof, wherein the hose accommodating groove extends along a longitudinal direction of the detergent hose to seat at least a portion of the detergent hose therein.

In one implementation, the water supply unit may include a water supply flow channel connected to a water supply hose for supplying water and connected to the water supply portion to deliver water to the water supply portion, the detergent hose may include a pair of detergent hoses, and the water supply flow channel may be located between the pair of detergent hoses.

In one implementation, the water supply unit may further include a fastening elastic protrusion protruding from one surface of the water supply unit facing the storage unit toward the storage unit, wherein the fastening elastic protrusion is elastically deformed and restored by the storage unit in a process of insertion and withdrawal of the storage unit, and the fastening elastic protrusion may be located between the water supply flow channel and the detergent hose.

According to another aspect of the present disclosure, provided is a laundry treating apparatus including a cabinet, a tub disposed inside the cabinet, and accommodating water therein, a drum disposed rotatably inside the tub, and accommodating laundry therein, and a detergent feeder disposed inside the cabinet, and supplying detergent into the drum.

The detergent feeder includes a storage unit including therein a storage space for storing detergent therein, a supply casing for accommodating the storage unit therein, and a water supply unit configured to supply water to the storage unit.

The water supply unit includes a water supply portion for supplying water to the storage unit, and a shower portion for receiving water from the water supply portion, and supplying water into the supply casing by avoiding the storage unit.

Embodiments of the present disclosure may provide the laundry treating apparatus that may effectively improve the cleanliness and the hygiene of the detergent feeder by effectively washing the interior of the supply casing.

In addition, embodiments of the present disclosure may provide the laundry treating apparatus in which the operation of the shower portion for washing the supply casing and the operation of the water supply portion for supplying the water to the storage unit may be made together through one water supply valve.

In addition, embodiments of the present disclosure may provide the laundry treating apparatus having the structure that may efficiently supply the detergent with the excellent space utilization through the optimal arrangement of the components.

DETAILED DESCRIPTION

Figure 1:
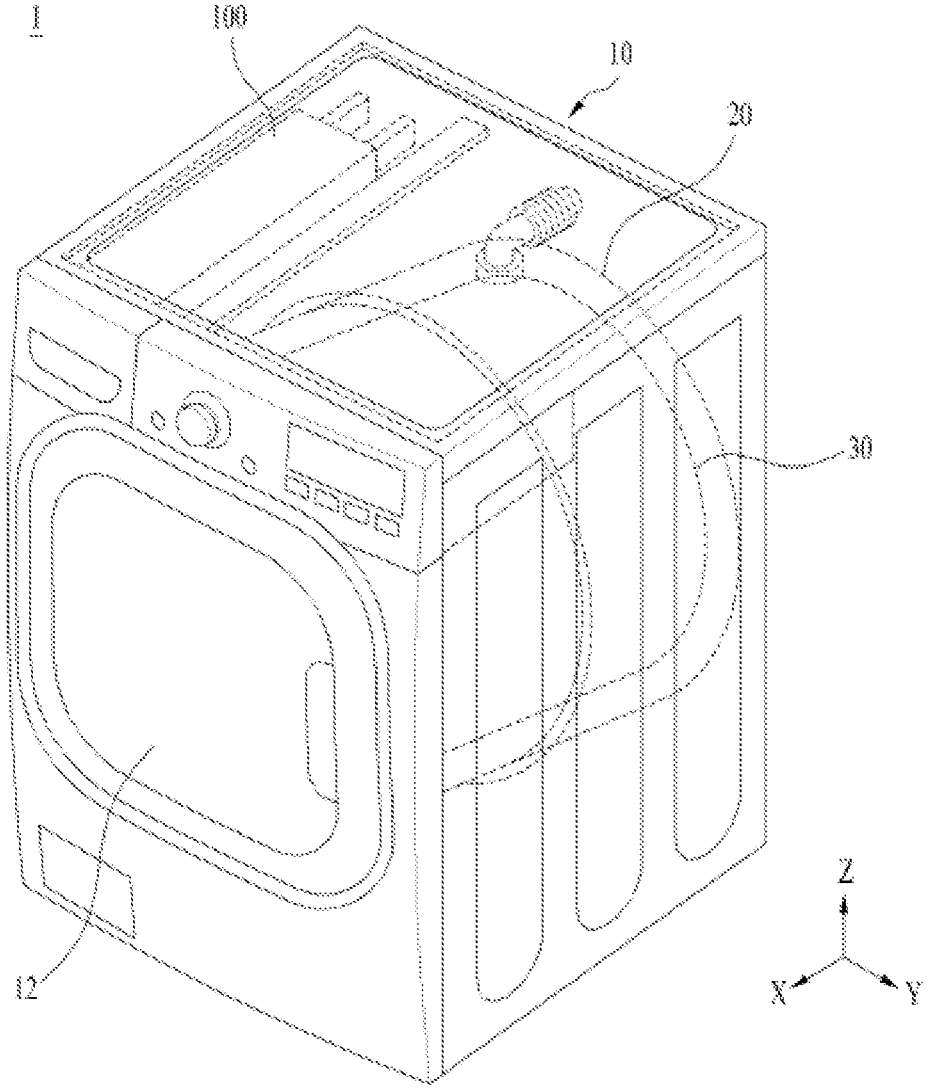
FIG. 1 is a perspective view showing a laundry treating apparatus according to an embodiment of the present disclosure.

Hereinafter, an embodiment of the present disclosure will be described in detail with reference to the accompanying drawings such that a person having ordinary knowledge in the technical field to which the present disclosure belongs may easily implement the embodiment.

However, the present disclosure is able to be implemented in various different forms and is not limited to the embodiment described herein. In addition, in order to clearly describe the present disclosure, components irrelevant to the description are omitted in the drawings. Further, similar reference numerals are assigned to similar components throughout the specification.

Duplicate descriptions of the same components are omitted herein.

In addition, it will be understood that when a component is referred to as being 'connected to' or 'coupled to' another component herein, it may be directly connected to or coupled to the other component, or one or more intervening components may be present. On the other hand, it will be understood that when a component is referred to as being 'directly connected to' or 'directly coupled to' another component herein, there are no other intervening components.

The terminology used in the detailed description is for the purpose of describing the embodiments of the present disclosure only and is not intended to be limiting of the present disclosure.

As used herein, the singular forms 'a' and 'an' are intended to include the plural forms as well, unless the context clearly indicates otherwise.

It should be understood that the terms 'comprises', 'comprising', 'includes', and 'including' when used herein, specify the presence of the features, numbers, steps, operations, components, parts, or combinations thereof described herein, but do not preclude the presence or addition of one or more other features, numbers, steps, operations, components, or combinations thereof.

In addition, in this specification, the term 'and/or' includes a combination of a plurality of listed items or any of the plurality of listed items. In the present specification, 'A or B' may include 'A', 'B', or 'both A and B'.

Figure 2:
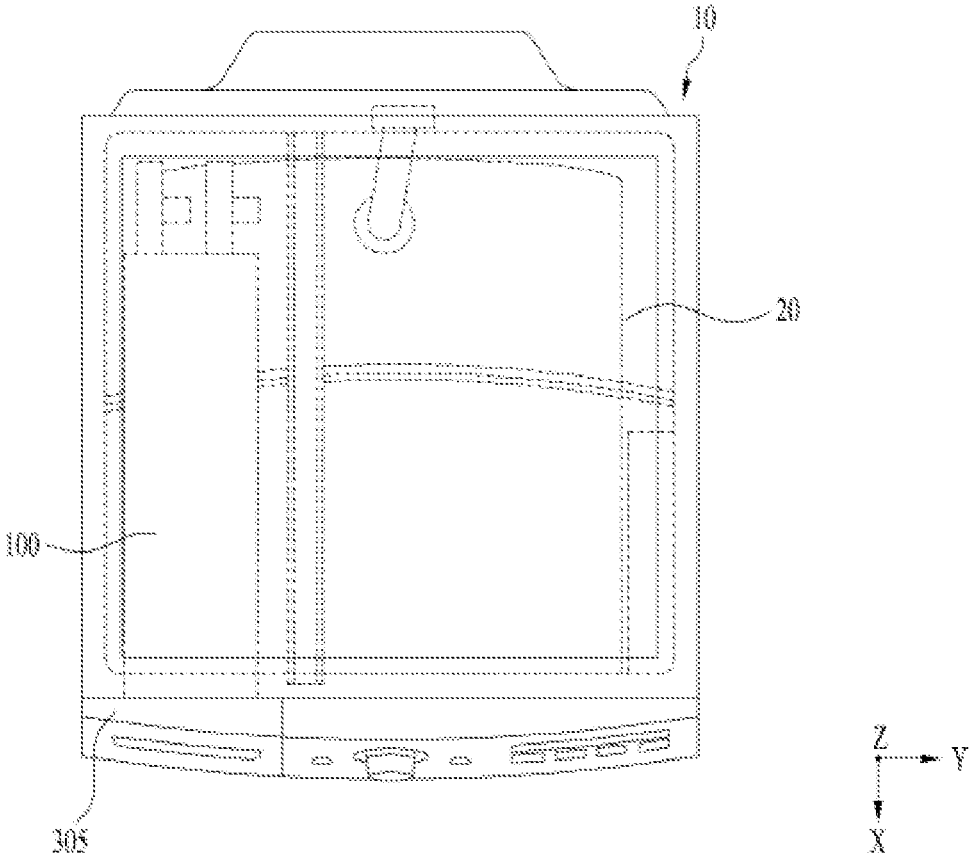
FIG. 2 is a view of a laundry treating apparatus according to an embodiment of the present disclosure viewed from above.
Figure 3:
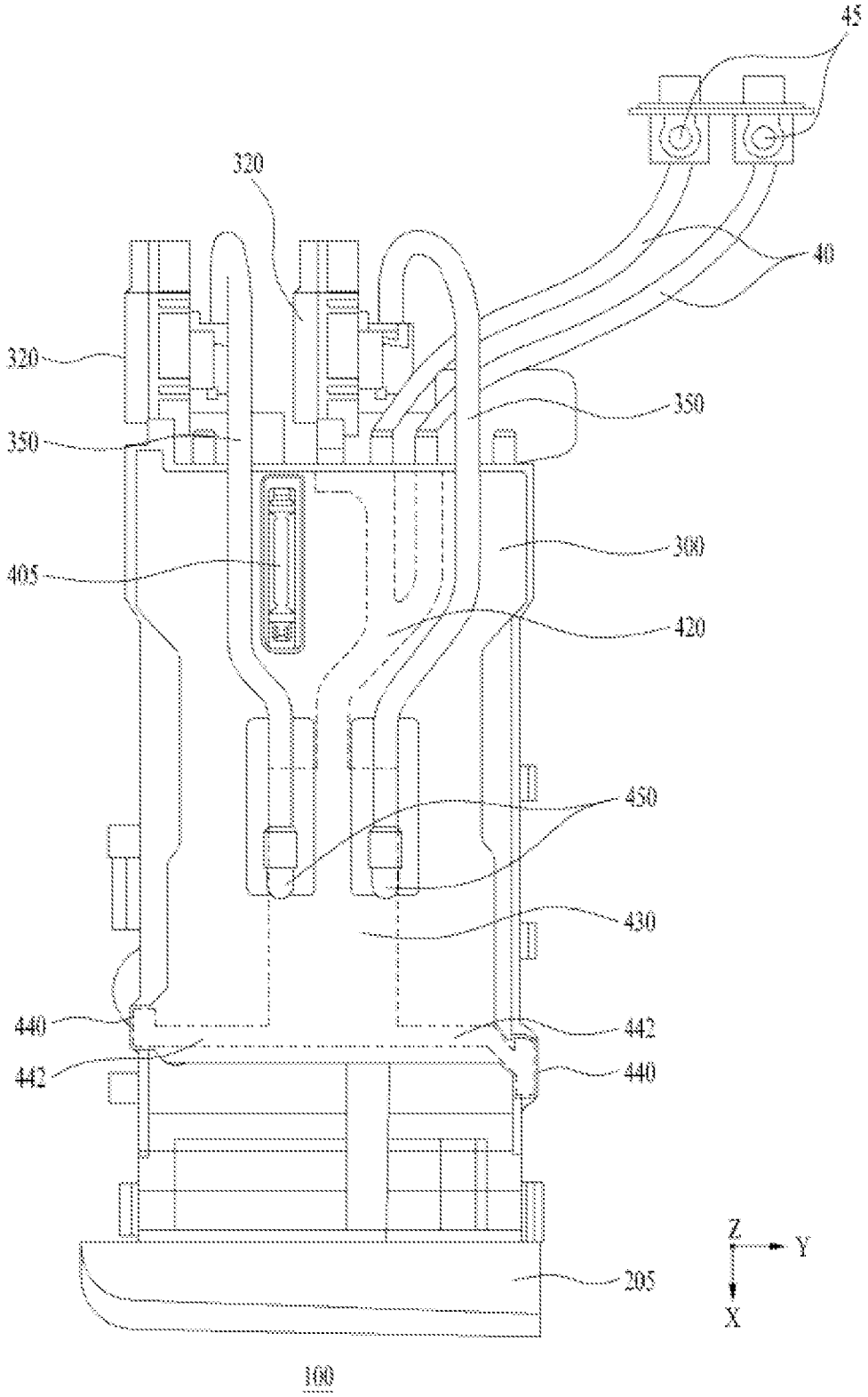
FIG. 3 is a top view showing a detergent feeder of a laundry treating apparatus according to an embodiment of the present disclosure.

FIG. 1 is a perspective view showing a laundry treating apparatus 1 according to an embodiment of the present disclosure, and FIG. 2 is a view of the laundry treating apparatus 1 viewed from above. FIG. 3 is a top view showing a detergent feeder 100 of the laundry treating apparatus 1 according to an embodiment of the present disclosure.

Referring to FIGS. 1 to 3, the laundry treating apparatus 1 according to an embodiment of the present disclosure includes a cabinet 10 having a detergent opening 18 defined in a front surface thereof, a tub 20 installed inside the cabinet 10, a drum 30 rotatably installed inside the tub 20, and the detergent feeder 100.

The laundry treating apparatus 1 may include a washing machine in which a cloth is inserted into the drum 30 to be subjected to washing, rinsing, and dehydration, a dryer in which a wet cloth is inserted to be subjected to drying, or the like.

The laundry treating apparatus 1 may be divided into a top load-type apparatus and a front load-type apparatus. FIG. 1 shows the laundry treating apparatus 1 of the front load-type, which is only for convenience of description, and is also applicable to the top load-type washing machines because the present disclosure does not apply only to the front load-type washing machines.

As shown in FIG. 1, the laundry treating apparatus 1 includes the cabinet 10 that forms an appearance thereof. The cabinet 10 may include a manipulation unit that receives various control commands from a user and displays information on an operating state. The manipulation unit may include a display for displaying the operating state.

The cabinet 10 may have a laundry opening and a laundry door 12 respectively defined in and formed on the front surface thereof. The user may put laundry, such as clothing, into the drum 30 through the laundry opening of the cabinet 10. The laundry door 12 may be pivotably formed on the cabinet 10 using a hinge or the like, and may be configured to open and close the laundry opening.

The cabinet 10, which forms the appearance of the laundry treating apparatus 1, may have a space defined therein in which various components constituting the laundry treating apparatus 1 may be accommodated. The drum 30 for accommodating therein the laundry input through the laundry opening may be installed inside the cabinet 10.

Inside the cabinet 10, the tub 20 for containing wash water therein, and the drum 30 rotatably disposed in the tub 20 and accommodating the laundry therein may be disposed. A balancer for compensating for eccentricity occurred by rotation may be installed on one side of the drum 30.

The above-described manipulation unit may include various keys for operating the operating state of the laundry treating apparatus 1 and the display for displaying the operating state of the laundry treating apparatus 1. The laundry door 12 may contain a transparent member such as tempered glass such that an interior of the cabinet 10 or the drum 30 may be visually identified.

In one example, in one embodiment of the present disclosure, the laundry treating apparatus 1 may have the detergent opening 18 on a front surface thereof, and a detergent feeder 100 may be positioned inside the cabinet 10 at the rear of the detergent opening 18.

A location and a shape of the detergent opening 18 may vary. FIG. 1 shows the detergent opening 18 defined in the front surface of the cabinet 10 and including an open hole. The detergent opening 18 may be located in a corner region on the front surface of the cabinet 10, for example, on one side of an upper end of the front surface, parallel to the manipulation unit in a lateral direction.

The front surface of the cabinet 10 may be formed in a form of a panel. For example, the cabinet 10 may include a front panel, a rear panel, side panels, a top panel, and a bottom panel. The definition of the direction in the present disclosure may be centered around the cabinet 10.

For example, in the cabinet 10, one surface in which the detergent opening 18 is defined may correspond to a front surface of the present disclosure. In addition, a front and rear direction may correspond to a moving direction of a storage unit 200, which will be described later.

The storage unit 200 may be moved rearwardly into the cabinet 10 to be inserted into the cabinet 10 through the detergent opening 18, and may be moved forward at the interior of the cabinet 10 to be withdrawn from the cabinet 10 through the detergent opening 18.

In one example, the detergent feeder 100 located at the rear of the detergent opening 18 may be located inside the cabinet 10 on one side of an upper portion of the cabinet 10. FIG. 2 shows the detergent feeder 100 positioned on one sides of the upper portion of the cabinet 10 as an embodiment of the present disclosure, but the location of the detergent feeder 100 is not necessarily limited thereto.

The detergent feeder 100 may include the storage unit 200 that may store detergent therein, a supply casing 300 that accommodates the storage unit 200 inserted into the cabinet 10 therein, and a water supply unit 400 that supplies water to the storage unit 200. FIG. 3 is the top view of the detergent feeder 100.

The detergent feeder 100 may supply the detergent stored in the storage unit 200 into the drum 30 or the tub 20 in a washing process or the like. The detergent means a substance that may enhance a washing effect of the laundry or a care effect of the laundry.

For example, the detergent may include a powdered or liquid fiber detergent and a liquid fabric softener.

Referring to FIG. 3, the laundry treating apparatus 1 according to an embodiment of the present disclosure may have a water supply valve 45 inside the cabinet 10. The water supply valve 45 may be connected to an external water supply source located outside the laundry treating apparatus 1, and may be configured to regulate flow of water supplied from the external water supply source.

For example, the water supply valve 45 may be in an open state to allow the flow of the water supplied from the external water supply source, or may be in a closed state to block the flow of the water. The water introduced through the water supply valve 45 may flow through a water supply hose 40 and be supplied to the detergent feeder 100.

FIG. 3 shows a pair of water supply valves 45 according to an embodiment of the present disclosure. One of the pair of water supply valves 45 may be connected to an external water supply source for cold water, and the other may be connected to an external water supply source for hot water.

The water supply hose 40 may also include a pair of water supply hoses, and one of the pair of water supply hoses may be coupled to the water supply valve 45 that is connected to the external water supply source for the cold water, and the other may be coupled to the water supply valve 45 that is connected to the external water supply source for the hot water.

The detergent feeder 100 may include a water supply connector 410 to which the water supply hose 40 is coupled. The water supply connector 410 may be disposed on the water supply unit 400, and the water supply unit 400 may include a water supply flow channel 420 through which water supplied through the water supply connector 410 flows, and may include a water supply portion 430 for supplying water supplied through the water supply flow channel 420 to the storage unit 200.

The water supply unit 400 may include a shower flow channel 442 extending from the water supply portion 430, and may include a shower portion 440 that receives water through the shower flow channel 442 and supplies the water to the supply casing 300. Because the shower portion 440 is supplied with water from the water supply portion 430, and the water supply portion 430 is supplied with water from the water supply hose 40 in which the flow of the water is regulated by the water supply valve 45, whether to operate the water supply portion 430 and the shower portion 440 may be determined only by controlling the single water supply valve 45.

In addition, the water supply unit 400 may have a fastening elastic protrusion 405 that provides sensory information on the insertion and withdrawal of the storage unit 200 to the user and improves usability by providing an elastic force to the storage unit 200 while being elastically deformed and restored by the storage unit 200 in the process of insertion and withdrawal of the storage unit 200.

The storage unit 200 may include a handle 205, and at least some of the detergent inside the storage unit 200 may flow out through a detergent pump 320 and be supplied to the water supply unit 400 through a detergent hose 350. The water supply unit 400 may have a detergent connector 450 to which the detergent hose 350 is coupled. A detailed description of the detergent flow between the storage unit 200 and the water supply unit 400 will be described later.

Figure 4:
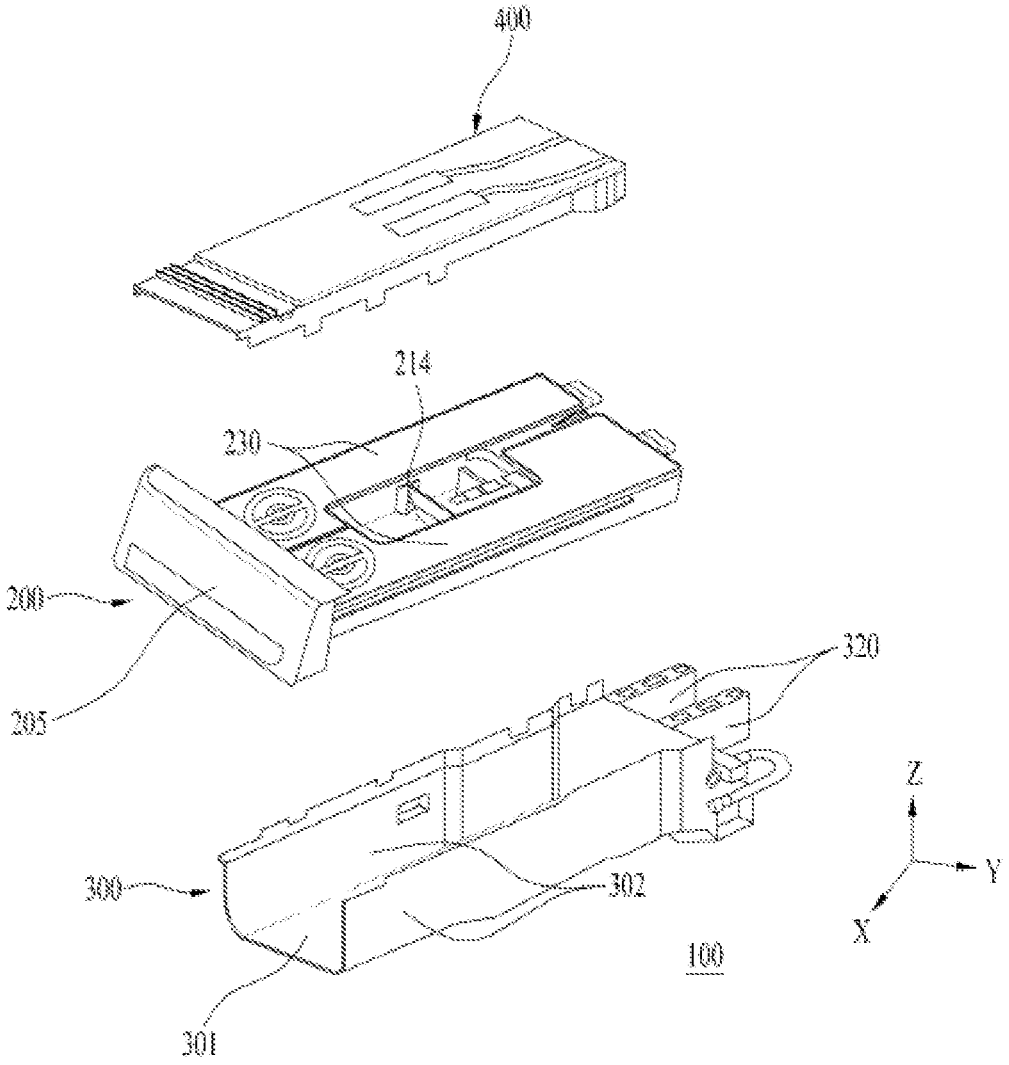
FIG. 4 shows a decomposed state of a laundry treating apparatus according to an embodiment of the present disclosure.

FIG. 4 shows a decomposed state of the detergent feeder 100. In the detergent feeder 100, the storage unit 200 may be located underneath the water supply unit 400, and the supply casing 300 may be located underneath the storage unit 200 based on FIG. 4.

The water supply unit 400 may receive water from the outside, and supply the received water back into the storage unit 200 or the supply casing 300. The water supply unit 400 may receive water from the external water supply source through the water supply hose 40 and the water supply valve 45.

The storage unit 200 may include a storage space 210 defined therein in which the detergent and the like are stored. The storage space 210 may be divided into a plurality of spaces. For example, the storage space 210 may include a first space 212 in which first detergent is stored and a second space 214 in which second detergent is stored.

The storage unit 200 may include a storage frame in which the storage space 210 is defined, the handle 205 disposed on a front surface of the storage frame, and a detergent cover 230 that is coupled to the storage frame and closes at least a portion of the storage space 210.

The supply casing 300 may include a bottom surface 301 positioned underneath the storage unit 200, and side walls 302 respectively positioned on both sides of the bottom surface 301 and the storage unit 200 in the lateral direction. The side walls 302 may be connected to the both sides of the bottom surface 301 in the lateral direction.

A space in which the storage unit 200 is accommodated may be defined in the supply casing 300. That is, the supply casing 300 may be configured to accommodate the storage unit 200 inserted into the cabinet 10. As will be described later, the supply casing 300 may have a drain portion 310 on the bottom surface 301. The detergent and the water discharged from the storage unit 200 or the water supply unit 400 may be discharged to the outside of the supply casing 300 through the drain portion 310, and the water and the detergent discharged to the outside of the supply casing 300 may be provided into the tub 20 or the drum 30.

In one embodiment of the present disclosure, the storage unit 200 may be inserted into or withdrawn out of the cabinet 10 through the detergent opening 18 defined in the front surface of the cabinet 10. That is, the storage unit 200 may be inserted or withdrawn along the front and rear direction.

In the present disclosure, even when the laundry door 12 and the detergent opening 18 are formed on different surfaces in the cabinet 10, front and rear sides may be defined based on the detergent opening 18 and the insertion and withdrawal direction of the storage unit 200.

Figure 5:
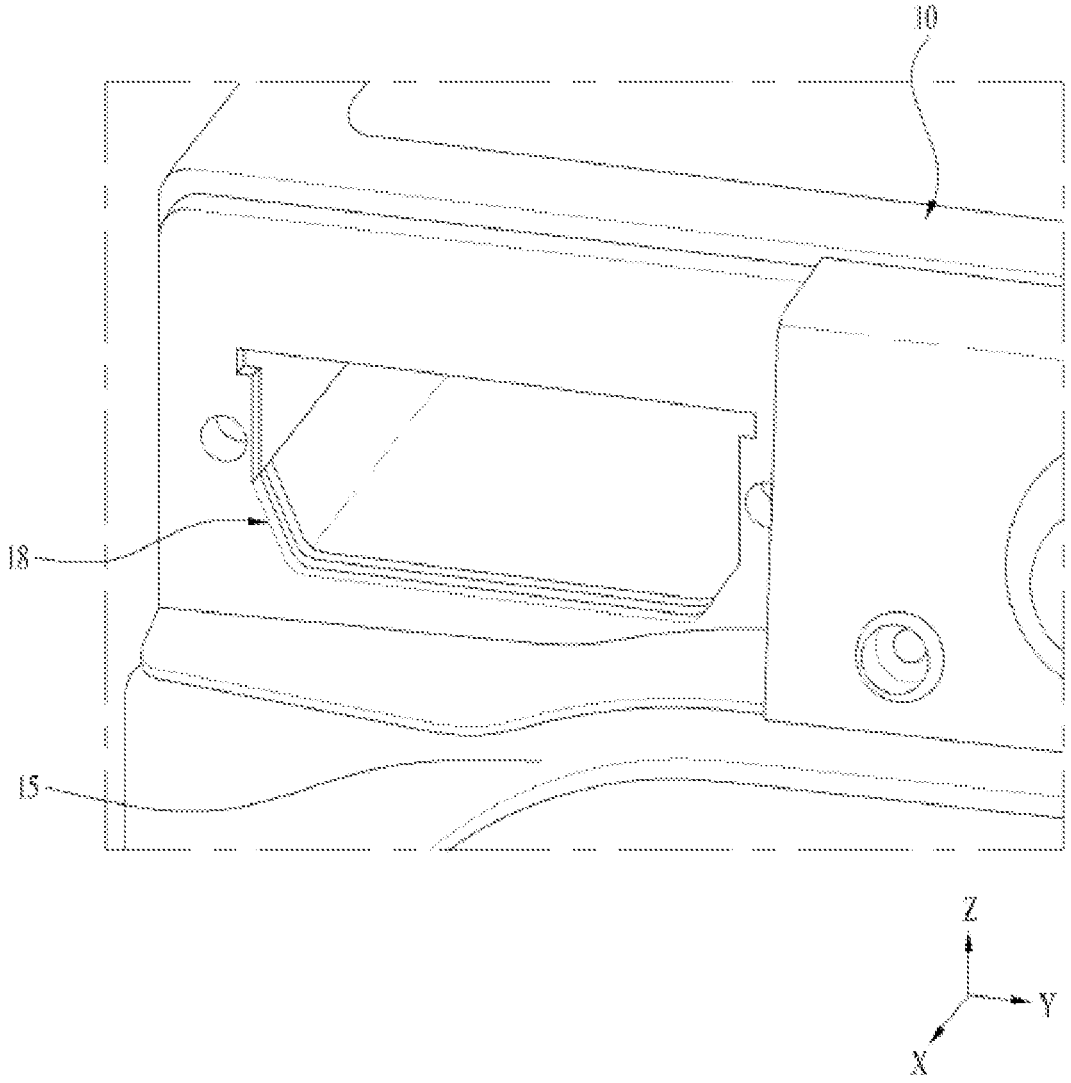
FIG. 5 shows a detergent opening of a laundry treating apparatus according to an embodiment of the present disclosure.

FIG. 5 shows the detergent opening 18 of the cabinet 10 viewed from the outside. A shape of the detergent opening 18 may vary. For example, an opening shape of the detergent opening 18 may correspond to a cross-sectional shape of the storage unit 200.

The detergent opening 18 may be defined in a portion of the front panel of the cabinet 10. The detergent opening 18 may be located on one side of an upper end of the front surface of the cabinet 10. The detergent opening 18 may be located above the laundry door 12.

The detergent opening 18 may be depressed rearwardly than the remaining portion of the front surface of the cabinet 10 excluding the detergent opening 18. As the detergent opening 18 is defined to be depressed, the handle 205 of the storage unit 200 may be positioned in front of the detergent opening 18 to form a portion of the front surface of the cabinet 10.

Figure 6:
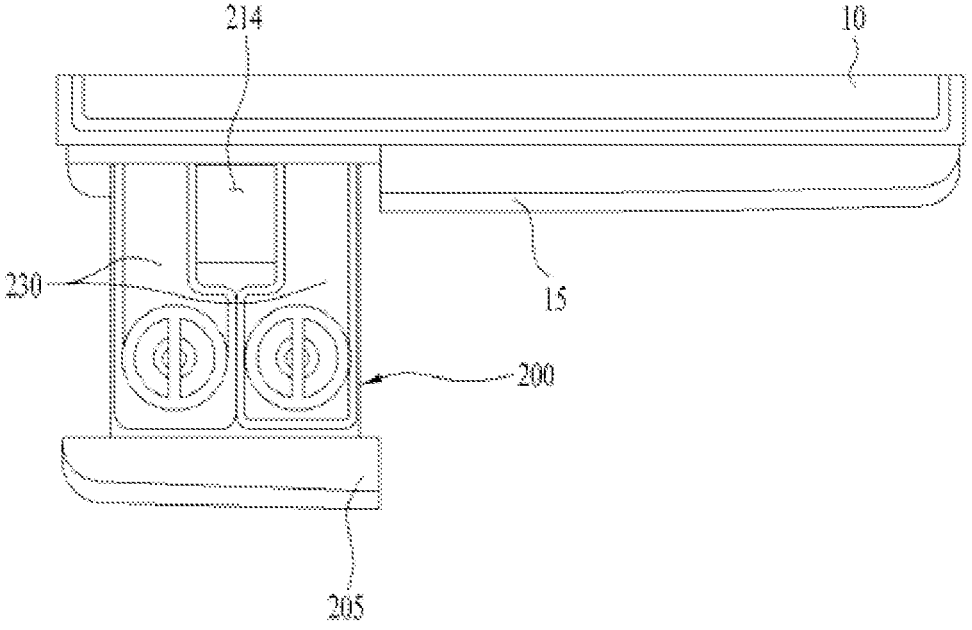
FIG. 6 shows a storage unit withdrawn through a detergent opening in a laundry treating apparatus according to an embodiment of the present disclosure.

In one example, FIG. 6 shows the storage unit 200 withdrawn from the cabinet 10 through the detergent opening 18 in one embodiment of the present disclosure. It may be a state in which the handle 205 is exposed to the outside while the storage unit 200 is inserted into the cabinet 10.

When the storage unit 200 is withdrawn out of the cabinet 10, the user may pull the storage unit 200 out of the cabinet 10 by gripping the handle 205 and pulling the storage unit 200 out. The storage unit 200 may be withdrawn by a set distance determined by design by a withdrawal limiting portion disposed in the storage unit 200.

In the state in which the storage unit 200 is withdrawn by the set distance, at least a portion of the first space 212 and the second space 214 may be exposed to the outside. In one embodiment of the present disclosure, the storage unit 200 may include the detergent cover 230 that closes the first space 212, and may further include a detergent cap that is detachably coupled to the detergent cover 230.

In the state in which the storage unit 200 is withdrawn by the set distance, the detergent cap may be exposed to the outside, and the user may separate the detergent cap from the storage unit 200 and put the detergent into the first space 212.

In the state in which the storage unit 200 is withdrawn by the set distance, at least a portion of the second space 214 may be exposed to the outside. The storage unit 200 may be configured such that one surface of the second space 214 is opened. For example, a top surface of the storage unit 200 may be opened as shown in FIG. 4. The user may put the detergent into the second space 214 through one open surface of the second space 214 exposed to the outside.

One embodiment of the present disclosure is advantageous in usability because the user may use the storage space 210 without completely separating the storage unit 200 from the cabinet 10 as the storage unit 200 is configured to be withdrawn by the set distance.

The withdrawal limiting portion may be configured such that at least a portion thereof is exposed in the state in which the storage unit 200 is withdrawn by the set distance, and the user may release the withdrawal distance limitation by the withdrawal limiting portion by manipulating the withdrawal limiting portion exposed to the outside. That is, the user may also manipulate the withdrawal limiting portion as needed to withdraw the storage unit 200 such that the cabinet is completely separated from the cabinet 10.

Figure 7:
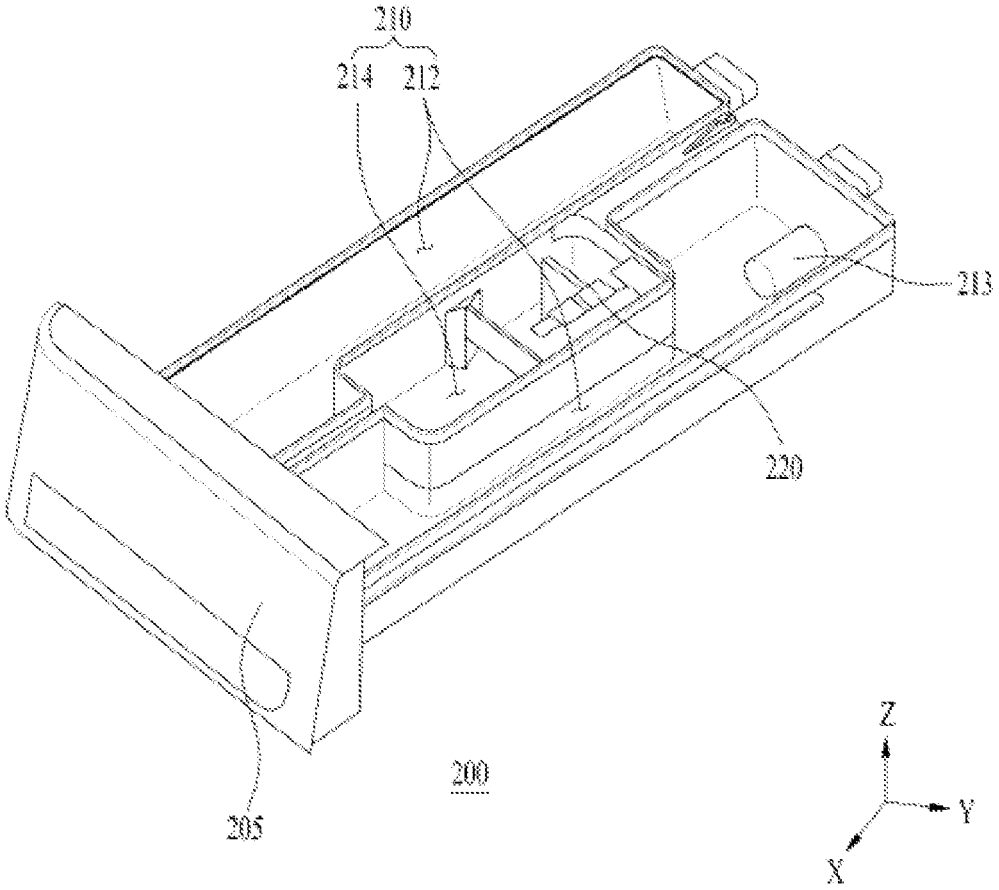
FIG. 7 is a view of a storage unit in a detergent feeder of a laundry treating apparatus according to an embodiment of the present disclosure.

In one example, FIG. 7 is a perspective view of the storage unit 200 from which the detergent cover 230 is separated. Referring to FIG. 7, in one embodiment of the present disclosure, the storage unit 200 may include the storage frame and the handle 205.

The handle 205 may be formed on the front surface of the storage frame. The handle 205 and the storage frame may be integrally molded or manufactured separately and coupled to each other. The handle 205 may form a portion of the front surface of cabinet 10 in the state in which the storage unit 200 is inserted into the cabinet 10.

The storage frame may have the storage space 210 defined therein in which the detergent is stored. The storage space 210 may be defined such that one surface thereof is opened to allow the detergent to be injected. The storage frame may include a partition wall for partitioning the storage space 210 therein.

The storage space 210 may be divided into the plurality of spaces by the partition wall. The storage space 210 partitioned by the partition wall may include the first space 212 and the second space 214. The first detergent may be stored in the first space 212, and the second detergent may be stored in the second space 214.

The first detergent and the second detergent may only be distinguished based on to the stored spaces, and characteristics thereof may not necessarily be different. However, the present disclosure allows the user to use various detergents by having the plurality of regions where the detergent may be stored.

Referring to FIG. 7, the storage space 210 of the storage frame may include a plurality of first spaces 212 extending along a longitudinal direction of the storage frame, for example, the front and rear direction of the cabinet 10. In one example, the second space 214 partitioned by the partition wall portion may be defined between the first spaces 212.

The second space 214 may have a shape surrounded by the first spaces 212. The storage frame may include a detergent connecting portion 213 for discharging the first detergent in the first space 212 to the outside. The detergent connecting portion 213 may be formed in a shape of a pipe in which flow of the detergent may be regulated.

The detergent connecting portion 213 may be configured to penetrate a rear wall of the storage frame, and may be connected to a detergent pump 320 to be described later. For example, when the storage unit 200 is inserted into the cabinet 10, as the detergent pump 320 of the supply casing 300 and the detergent connecting portion 213 are connected to each other, and the detergent connecting portion 213 is configured to allow the detergent flow as the detergent pump 320 is connected thereto, the first detergent in the first space 212 may be leaked to the outside of the storage unit 200 by the detergent pump 320.

The storage unit 200 may include a detergent discharge portion 220 in communication with the second space 214. The detergent discharge portion 220 may be located in the second space 214 in the storage frame. The detergent discharge portion 220 may be configured as a passage through which the detergent and water present in the second space 214 are discharged to the outside.

The detergent discharge portion 220 may be disposed on a portion forming a bottom of the second space 214 in the storage frame. The detergent discharge portion 220 may include an opening for the detergent to be discharged, and the detergent or the like discharged through the detergent discharge portion 220 may be delivered to the bottom surface 301 of the supply casing 300.

Figure 8:
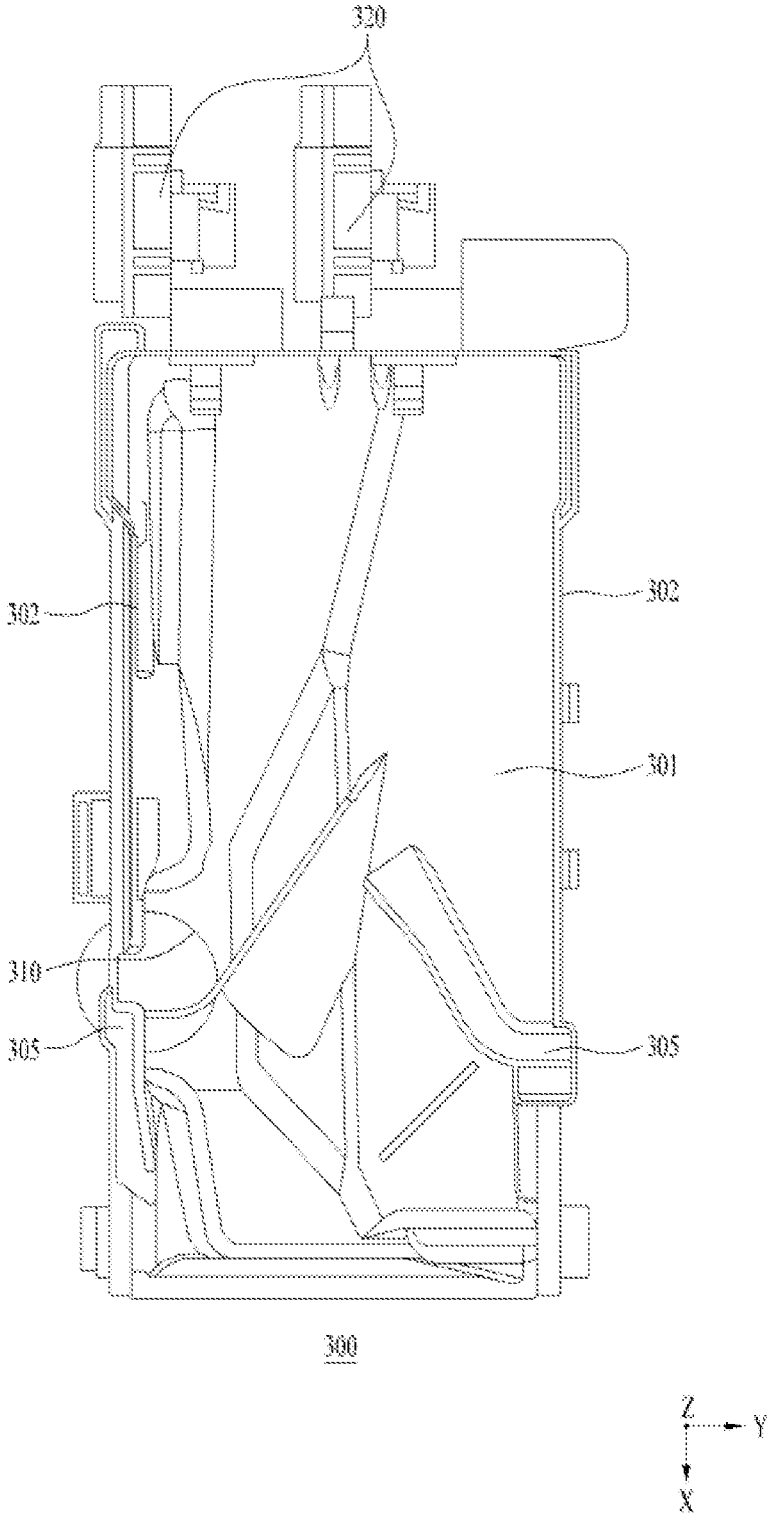
FIG. 8 shows a supply casing in a detergent feeder of a laundry treating apparatus according to an embodiment of the present disclosure.

FIG. 8 shows the supply casing 300 according to an embodiment of the present disclosure viewed from above. The supply casing 300 may include the bottom surface 301 and the side walls 302, and the storage unit 200 may be accommodated in a space defined by the bottom surface 301 and the side walls 302.

The supply casing 300 has the open front surface, so that storage unit 200, which is inserted into the cabinet 10 through the detergent opening 18, may move into the supply casing 300. The supply casing 300 has an open top surface, and a water supply unit 400 may be disposed on top of the supply casing 300.

As will be described later, the water supply unit 400 may be configured to discharge the water to the outside. The water discharged from the water supply unit 400 may be supplied into the storage unit 200 and the supply casing 300 through the open top surface of the supply casing 300.

The water supply unit 400 may be positioned above the supply casing 300 to shield the top surface of the supply casing 300. The water supply unit 400 may be coupled to the supply casing 300 to define a space in which the storage unit 200 is accommodated.

The storage unit 200 is inserted into the cabinet 10 through the detergent opening 18, and the supply casing 300 may have the detergent pump 320 connected to the storage unit 200 on the rear wall. The detergent pump 320 may be of various types.

FIG. 8 shows the detergent pump 320 including a plurality of detergent pumps to correspond to the number of first spaces 212 defined in the storage unit 200 according to an embodiment of the present disclosure. The detergent pump 320 is disposed on the rear wall of the supply casing 300, so that the detergent pump 320 may be connected to the storage unit 200 fully inserted into the cabinet 10.

The detergent pump 320 may be located at the rear of the rear wall of the supply casing 300 and may have a connector penetrating the rear wall of the supply casing 300. The connector may be connected to the detergent connecting portion 213 of the storage unit 200 that is introduced into the cabinet 10.

The bottom surface 301 of the supply casing 300 may be formed in a shape favorable to the flow of the detergent and the water. The supply casing 300 may have the drain portion 310 for discharging the detergent and the water on the bottom surface 301.

The drain portion 310 may be configured to discharge the detergent and the water to the outside through the opening. The detergent and the water discharged through the drain portion 310 may be supplied to the drum 30 or the tub 20. The bottom surface 301 of the supply casing 300 may be inclined or grooved such that the detergent and the water flow toward the drain portion 310.

A shower water flow groove 305 may be defined in the side wall 302 of the supply casing 300. The shower water flow groove 305 may extend from the side wall 302 of the supply casing 300 toward the bottom surface 301 of the supply casing 300, and may have a shape recessed in a direction away from the storage unit 200.

The shower water flow groove 305 may have an open top surface facing the water supply unit 400. The water discharged from the water supply unit 400 may be delivered into the shower water flow groove 305 and flow through the open top surface of the shower water flow groove 305.

As will be described later, the water supply unit 400 may include the shower portion 440 for supplying water to the supply casing 300 by avoiding the storage unit 200, and the shower water flow groove 305 may be positioned below the shower portion 440.

That is, water falling through the shower portion 440 of the water supply unit 400 may avoid the storage unit 200 and flow into the shower water flow groove 305. The shower water flow groove 305 may become means for guiding the water introduced through the shower portion 440 to flow through the entire bottom surface 301 including a front portion of the bottom surface 301 of the supply casing 300.

Figure 9:
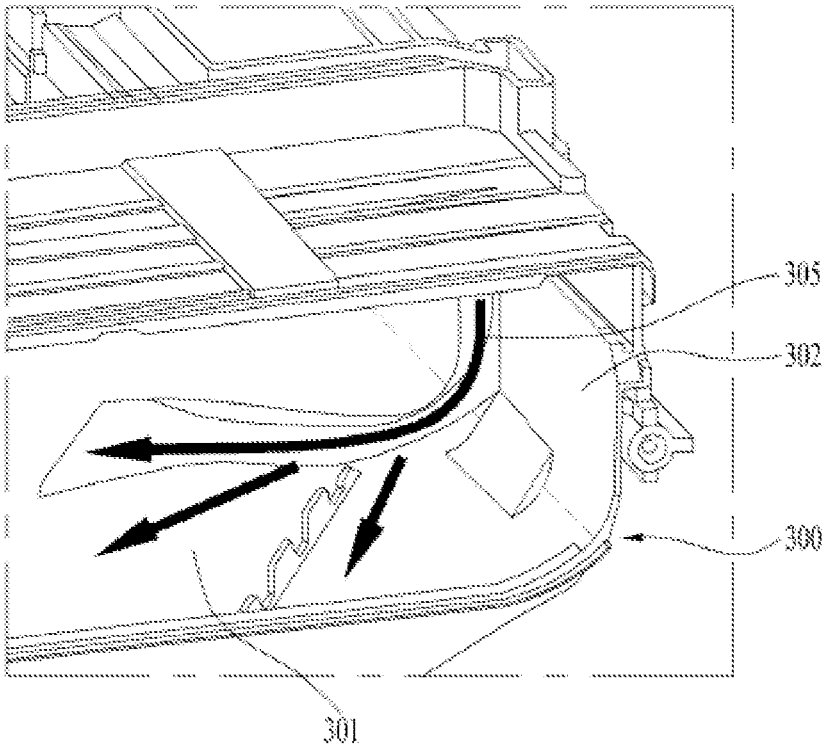
FIG. 9 shows a shower water flow groove defined in a supply casing in a laundry treating apparatus according to an embodiment of the present disclosure.

FIG. 9 shows the shower water flow groove 305 defined in the supply casing 300 according to an embodiment of the present disclosure, and a detailed description of FIG. 9 will be described later.

Figure 10:
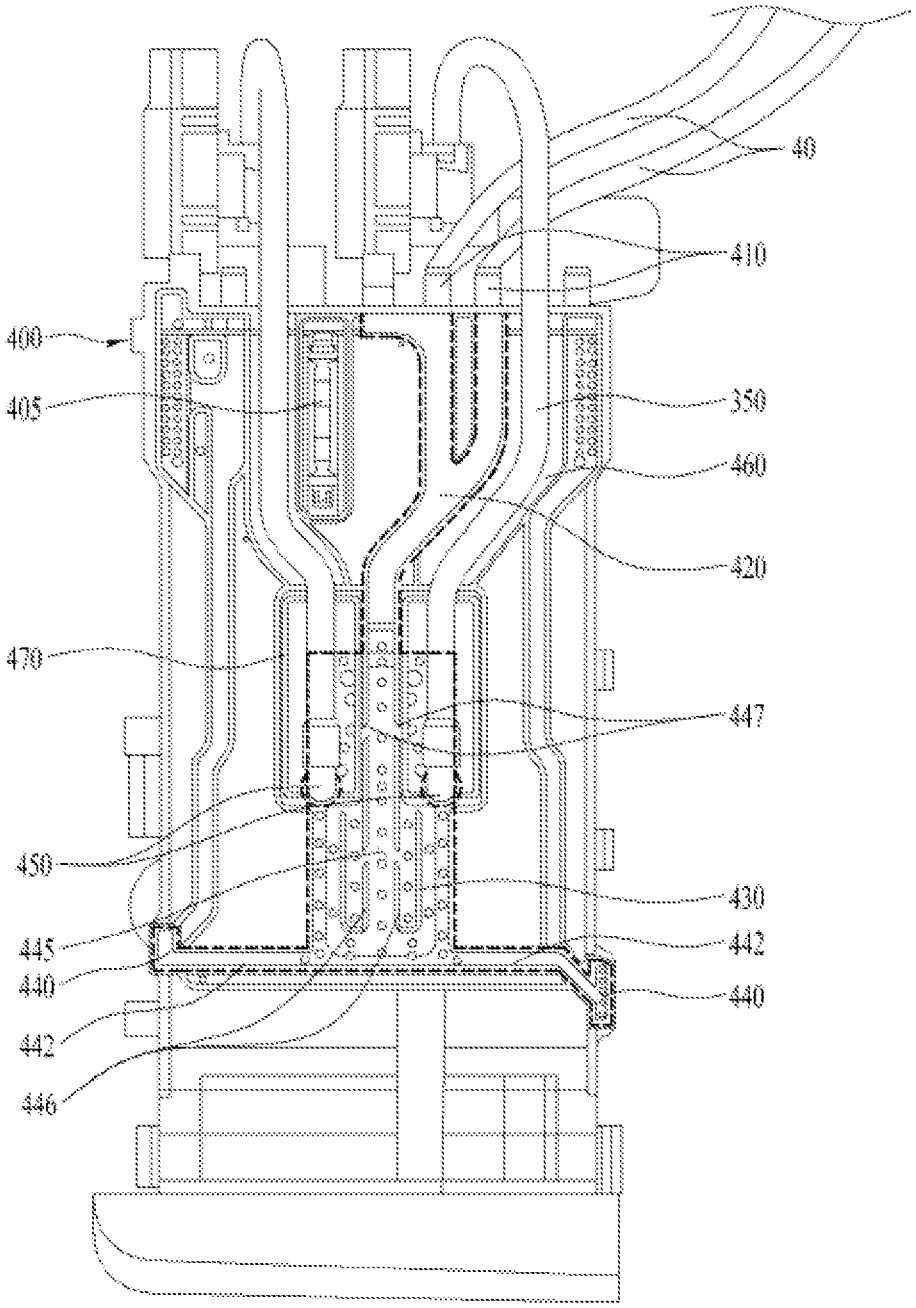
FIG. 10 shows a water supply unit in a detergent feeder of a laundry treating apparatus according to an embodiment of the present disclosure viewed from above.
Figure 11:
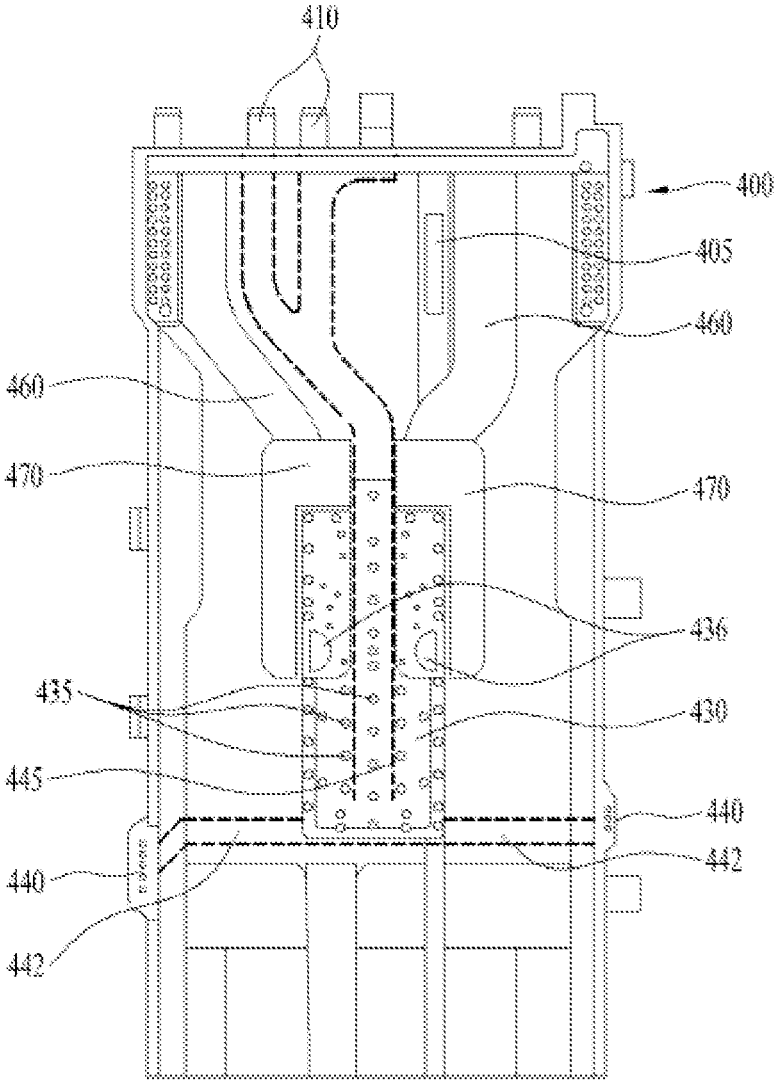
FIG. 11 shows a water supply unit in a detergent feeder of a laundry treating apparatus according to an embodiment of the present disclosure viewed from below.

In one example, FIG. 10 shows the water supply unit 400 according to an embodiment of the present disclosure viewed from above, and FIG. 11 shows the water supply unit 400 viewed from below.

As described above, the laundry treating apparatus 1 according to an embodiment of the present disclosure may include the cabinet 10, the tub 20, the drum 30, and the detergent feeder 100. The cabinet 10 may have the detergent opening 18 defined in the front surface thereof, the tub 20 may be disposed inside the cabinet 10, and accommodate the water therein, the drum 30 may be rotatably disposed inside the tub 20, and accommodate the laundry therein, and the detergent feeder 100 may be disposed inside the cabinet 10, and supply the detergent into the drum 30.

The detergent feeder 100 may include the storage unit 200, the supply casing 300, and the water supply unit 400. The storage unit 200 is inserted into the cabinet 10 through the detergent opening 18 and includes the storage space 210 in which the detergent is stored.

The supply casing 300 may accommodate the storage unit 200 therein. The water supply unit 400 may be configured to supply the water to the storage unit 200. The water supply unit 400 may include the water supply portion 430, the shower portion 440, and the shower flow channel 442.

The water supply portion 430 may supply the water to the storage unit 200, the shower portion 440 may supply the water into the supply casing 300 by avoiding the storage unit 200, and the shower flow channel 442 may extend from the water supply portion 430 and be connected to the shower portion 440 to transfer the water from the water supply portion 430 to the shower portion 440.

That is, the shower portion 440 may receive the water from the water supply portion 430 and supply the water into the supply casing 300 by avoiding the storage unit 200.

Referring to FIGS. 10 and 11, the water supply unit 400 may include the water supply connector 410 connected to the water supply hose 40. Referring to FIG. 3, the water supply hose 40 may be connected to the water supply valve 45, and the water supply valve 45 may be connected to the external water supply source.

That is, the water supplied from the external water supply source may be supplied into the water supply unit 400 through the water supply valve 45, the water supply hose 40, and the water supply connector 410. The water supply flow channel 420 through which the water delivered through the water supply hose 40 flows by being connected to the water supply connector 410 may be disposed inside the water supply unit 400.

In the detergent feeder 100 according to an embodiment of the present disclosure, the first detergent stored in the first space 212 of the storage unit 200 may be supplied to the water supply unit 400 through the detergent pump 320 and the detergent hose 350. The detergent hose 350 may be extended along an outer surface of the water supply unit 400 to directly supply the first detergent to the water supply portion 430 of the water supply unit 400.

The detergent connector 450 in communication with the water supply portion 430 of the water supply unit 400 may be further included. The detergent connector 450 and the detergent hose 350 may be connected to each other, so that the detergent flowing through the detergent hose 350, that is, the first detergent, may be directly supplied to the water supply portion 430 and may be provided to the second space 214 of the storage unit 200 together with the water.

In one example, the shower portion 440 may be configured to supply the water into the supply casing 300 while avoiding the storage unit 200. The storage unit 200 may include the detergent discharge portion 220 as described above. There is a possibility that some of the detergent stored in the storage space 210 may unintentionally leak to the bottom surface 301 of the supply casing 300 in the process in which the storage is inserted into or withdrawn from the cabinet 10.

The shower portion 440 may wash an inner surface of the supply casing 300 by supplying the water starting from the inner surface of the supply casing 300. Accordingly, one embodiment of the present disclosure may simply and effectively maintain internal cleanliness of the supply casing 300, so that hygiene may be improved.

In one example, the shower portion 440 may be configured to receive the water from the water supply portion 430 through the shower flow channel 442. The shower flow channel 442 connects the water supply portion 430 and the shower portion 440 to each other and serves as a path through which the water of the water supply portion 430 flows toward the shower portion 440.

That is, in one embodiment of the present disclosure, as the shower portion 440 receives the water from the water supply portion 430, there is no need to form a separate hose or flow channel connected to the external water supply source, so that the water may be supplied to the shower portion 440 simply and effectively. Shapes of the water supply portion 430 and the shower flow channel 442 may vary.

In one example, in one embodiment of the present disclosure, the water supply unit 400 is configured to receive the flowing water through the water supply valve 45, so that the flow of the water supplied to the water supply portion 430 and the shower portion 440 may be regulated together based on the opening and closing of the water supply valve 45.

FIG. 3 described above shows the water supply valve 45 capable of regulating the flow of water supplied to the water supply portion 430 and the shower portion 440 together. The water supply valve 45 may be of various types capable of regulating the flow of the water through the water supply hose 40.

In one embodiment of the present disclosure, as the water supply unit 400 receives the water through the water supply hose 40 connected to the water supply valve 45, the operation of the water supply portion 430 and the operation of the shower portion 440 may be adjusted together with only manipulation of the water supply valve 45, so that whether to supply the water of the water supply portion 430 and the shower portion 440 may be determined easily and effectively in structure.

In one example, in one embodiment of the present disclosure, the storage unit 200 may include the first space 212 in which the first detergent is stored and the second space 214 in which the second detergent is stored, the first detergent may be delivered to the water supply unit 400 through the detergent hose 350, and the water supply unit 400 may supply the first detergent and the water to the second space 214 through the water supply portion 430.

The storage unit 200 including the first space 212, the second space 214, and the detergent discharge portion 220 is shown in FIG. 7, and the water supply portion 430 that delivers the first detergent and the water to the second space 214 is shown in FIG. 4.

In one embodiment of the present disclosure, in the storage unit 200, the storage space 210 may be partitioned into the plurality of spaces. For example, the storage space 210 may be partitioned into the first space 212 in which the first detergent is stored and the second space 214 in which the second detergent is stored, and the partition wall for partitioning the storage space 210 may be disposed inside the storage unit 200.

Referring to FIG. 7, in the storage space 210, the second space 214 may be surrounded by the partition wall and partitioned from the first space 212 to prevent mixing of the detergents, and the first space 212 may be partitioned into the plurality of spaces by the partition wall. FIG. 7 shows the pair of first spaces 212 extending in the front and rear direction and the second space 214 positioned to be surrounded by the first spaces 212.

In one example, the storage unit 200 may have the detergent discharge portion 220 in communication with the second space 214. That is, the detergent or the water present in the second space 214 may be discharged to the outside through the detergent discharge portion 220, and the detergent or the like discharged from the storage unit 200 may be supplied to the bottom surface 301 of the supply casing 300 or the like.

The supply casing 300 may include the drain portion 310 through which the detergent, the water, and the like inside may be discharged, as shown in FIG. 8, and the detergent, the water, and the like discharged from the storage unit 200 or the water supply unit 400 may be discharged from the detergent feeder 100 through the drain portion 310 and provided to the drum 30 or the tub 20.

In one embodiment of the present disclosure, the first detergent stored in the first space 212 of the storage unit 200 may be delivered to the water supply portion 430 of the water supply unit 400 through the detergent hose 350. That is, the storage unit 200 may discharge the first detergent to the outside even when the storage unit 200 does not include a separate component for discharging the detergent of the first space 212 to the outside.

In one example, the first detergent supplied to the water supply unit 400 through the detergent hose 350 may be supplied to the second space 214 of the storage unit 200 through the water supply portion 430 together with the water. The storage unit 200 may discharge the detergent or the like of the second space 214 through the detergent discharge portion 220 to the outside.

That is, one embodiment of the present disclosure may improve structural efficiency because the detergent in the entire storage space 210 may eventually be discharged to the outside of storage unit 200 even when the detergent discharge portion 220 from which the detergent may be discharged is disposed only in one of the partitioned spaces, for example, the second space 214 in the case in which the storage space 210 is partitioned into the plurality of spaces to improve the usability.

In one example, as shown in FIG. 10, in one embodiment of the present disclosure, at least a portion of the detergent hose 350 may extend along the outer surface of the water supply unit 400, and the water supply unit 400 may include a hose accommodating groove 460 extending along the longitudinal direction of the detergent hose 350 defined in the outer surface, and accommodating the at least a portion of the detergent hose 350 therein.

The detergent hose 350 may be directly connected to the storage unit 200 or to the detergent pump 320 of the supply casing 300. When the detergent hose 350 is connected to the detergent pump 320 of the supply casing 300, the detergent pump 320 may be connected to the first space 212 of the storage unit 200 accommodated in the supply casing 300.

Specifically, the storage unit 200 may include the detergent connecting portion 213 in communication with the first space 212, and the detergent connecting portion 213 may be formed in the shape of the pipe that allows the flow of the detergent only when being connected to the detergent pump 320.

The detergent connecting portion 213 may have a structure including a valve that allows fluid flow when the detergent pump 320 is connected to an interior thereof in a shape of a pipe that connects the first space 212 of the storage unit 200 and an exterior of the storage unit 200 to each other.

In one example, the detergent hose 350 may extend from the supply casing 300 or the storage unit 200 along the outer surface of water supply unit 400 to be connected to water supply portion 430. The water supply portion 430 may be located above the second space 214 of the storage unit 200 when referring to FIG. 4 and the like, and may be configured to discharge the water and the detergent downward.

As above, when the water supply portion 430 is located above the second space 214, the detergent connector 450 may be disposed on a top surface of the water supply portion 430. That is, the detergent connector 450 may be configured to deliver the detergent supplied from the detergent hose 350 directly to an internal space of the water supply portion 430 even when there is no separate flow channel.

In one embodiment of the present disclosure, the detergent hose 350 directly extends along the outer surface of the water supply unit 400 to supply the detergent to the water supply portion 430 without forming the separate flow channel through which the detergent flows inside the water supply unit 400, so that the cleanness and the hygiene may be improved because there is no flow channel through which the detergent flows inside the water supply unit 400.

In addition, in one embodiment of the present disclosure, as shown in FIG. 9, the hose accommodating groove 460 in which the detergent hose 350 is accommodated may be defined in the outer surface of the water supply unit 400. The hose accommodating groove 460 may be configured to extend along the longitudinal direction of the detergent hose 350 such that the detergent hose 350 is accommodated therein.

In one embodiment of the present disclosure, even when the detergent hose 350 extends along the outer surface of water supply unit 400, because the detergent hose 350 is accommodated in the hose accommodating groove 460, a volume occupied by the detergent hose 350 by protruding from the water supply unit 400 is greatly reduced. Thus, a space efficiency may be greatly improved, and the storage space 210 of the storage unit 200 may be effectively secured in response thereto.

In one example, in one embodiment of the present disclosure, the water supply unit 400 includes the water supply flow channel 420 connected to the water supply hose 40 to which the water is supplied, and connected to the water supply portion 430 to deliver the water to the water supply portion 430. The detergent hose 350 may include a pair of detergent hoses, and the water supply flow channel 420 may be located between the pair of detergent hoses 350.

Referring to FIG. 10, in one embodiment of the present disclosure, the water supply connector 410 to which the water supply hose 40 is coupled may be disposed at a rear end of the water supply unit 400, and the water supply flow channel 420 connecting the water supply connector 410 and the water supply portion 430 to each other may be disposed inside the water supply unit 400.

The water supply flow channel 420 may be located approximately at a center with respect to a width direction of the water supply unit 400 and may have a shape forwardly extending from the rear end of the water supply unit 400.

In one example, the storage unit 200 may include the pair of first spaces 212 as shown in FIG. 7, the first spaces 212 may be connected to different detergent pumps 320 and detergent hoses 350. That is, in one embodiment of the present disclosure, the pair of detergent hoses 350 may be connected to the water supply unit 400.

The detergent hose 350 may be connected to the detergent pump 320 disposed at the rear end of the supply casing 300, and thus, may extend forwardly on the top surface of the water supply unit 400. Accordingly, the hose accommodating groove 460 of the water supply unit 400 may extend forwardly from the rear end of the water supply unit 400. The hose accommodating groove 460 may extend from the rear end of the water supply unit 400 toward the detergent connector 450.

Because the hose accommodating groove 460 has a shape of a groove that is depressed inwardly of the water supply unit 400 from the outer surface of the water supply unit 400, and the water supply flow channel 420 must have a space in which the water flows therein, the hose accommodating groove 460 and the water supply flow channel 420 may be configured to occupy spaces in the water supply unit 400 together.

In addition, because the hose accommodating groove 460 and the water supply flow channel 420 approximately extend forwardly from the rear end of the water supply unit 400 together, structural design through optimal arrangement of the hose accommodating groove 460 and the water supply flow channel 420 may be an important issue.

In one embodiment of the present disclosure, a pair of hose accommodating grooves 460 are defined in the outer surface of the water supply unit 400 to correspond to the pair of detergent hoses 350, and the water supply flow channel 420 may be positioned between the pair of hose accommodating grooves 460.

Accordingly, the water supply flow channel 420 and the hose accommodating groove 460 may be arranged without structural interference therebetween, so that space utilization may be greatly improved.

In one example, in one embodiment of the present disclosure, in the water supply unit 400, the water provided from the water supply hose 40 in which the flow of the water is regulated by the water supply valve 45 may be delivered to the water supply portion 430 through the internal water supply flow channel 420, and the water delivered to the water supply portion 430 may be delivered to the shower portion 440 through the shower flow channel 442.

In one embodiment of the present disclosure, a structure is not complicated as a separate hose or valve for the shower portion 440 is not disposed, and efficient operation of the detergent feeder 100 possible as whether to supply the water of the water supply portion 430 and the shower portion 440 may be determined through one valve and hose.

In one example, in one embodiment of the present disclosure, the storage unit 200 may include the detergent discharge portion 220 from which the detergent and the water supplied through the water supply portion 430 are discharged, and at least a portion of the shower portion 440 may be located frontward of the detergent discharge portion 220 to supply the water forwardly than the detergent discharge portion 220.

FIG. 7 shows a state in which the detergent discharge portion 220 is located at a lower portion of the second space 214 according to an embodiment of the present disclosure, and FIG. 10 shows a state in which at least a portion of the shower portion 440 is positioned forwardly of the water supply portion 430 positioned above the second space 214.

In one embodiment of the present disclosure, as the shower portion 440 is located forwardly of the detergent discharge portion 220, the water may be supplied to a front portion of the second space 214. Accordingly, the detergent leaking unintentionally from the detergent discharge portion 220 in the process of insertion and withdrawal may be effectively washed through the water supplied from the shower portion 440.

That is, in one embodiment of the present disclosure, at least a portion of the shower portion 440 is positioned forwardly of the water supply portion 430, so that the water may be discharged forwardly of the water supply portion 430. Because the water discharged from the shower portion 440 is supplied into the supply casing 300 while avoiding the storage unit 200, the water discharged from the shower portion 440 may wash the side walls 302 and the bottom surface 301 of the supply casing 300.

In one example, in one embodiment of the present disclosure, the water supply unit 400 may include therein the water supply flow channel 420 that is connected to the water supply portion 430 therein to flow the water toward the water supply portion 430, the water supply portion 430 may include therein a delivery flow channel 445 extending from the water supply flow channel 420 toward the shower flow channel 442, and the delivery flow channel 445 may be configured such that a portion thereof is in communication with the interior of the water supply portion 430 to allow the water supplied through the water supply flow channel 420 to be supplied into the water supply portion 430.

Figure 12:
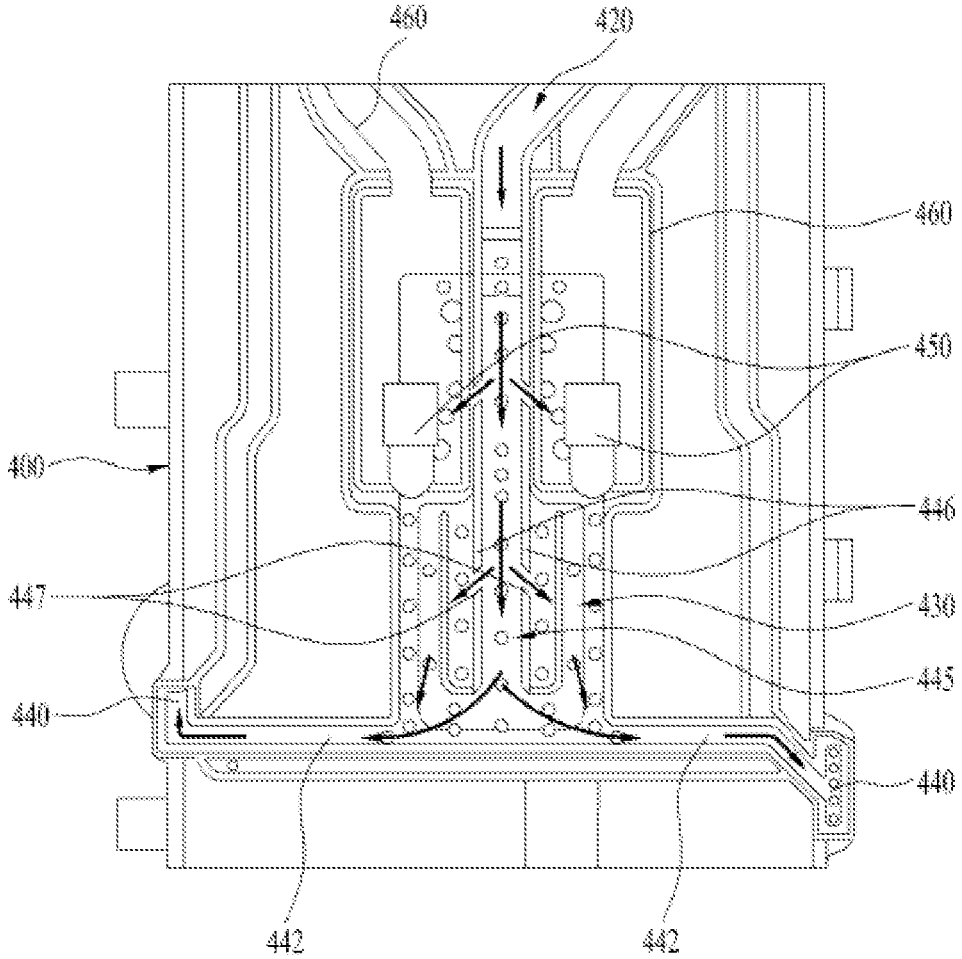
FIG. 12 is a view showing a water supply portion and a shower portion of a water supply portion in a detergent feeder of a laundry treating apparatus according to an embodiment of the present disclosure.

FIGS. 10 and 11 show the delivery flow channel 445 according to an embodiment of the present disclosure, and FIG. 12 shows an enlarged view of the delivery flow channel 445 and the shower flow channel 442 according to an embodiment of the present disclosure.

As described above, the water supply flow channel 420 may be disposed inside the water supply unit 400 to connect the water supply connector 410 and the water supply portion 430 to each other. That is, the water supply flow channel 420 may be a path through which the water flowing into the water supply unit 400 through the water supply hose 40 flows toward the water supply portion 430.

The water supply portion 430 may have the delivery flow channel 445 therein. The delivery flow channel 445 may be a path for flowing the water introduced from the water supply flow channel 420 toward the shower flow channel. The delivery flow channel 445 may be configured such that a rear end thereof is directly connected to the water supply flow channel 420 or faces an opening of the water supply flow channel 420, and a front end of the delivery flow channel 445 may be positioned on a side of the shower flow channel 442.

The delivery flow channel 445 may extend across the interior space of the water supply portion 430. The internal space of the water supply portion 430 may correspond to a space in which the water to be discharged to the outside through the water supply portion 430 stays before being discharged.

The delivery flow channel 445 may be configured such that at least a portion thereof is opened. That is, the delivery flow channel 445 may be configured such that an interior and an exterior thereof communicate each other. The exterior of the delivery flow channel 445 may correspond to the internal space of the water supply portion 430.

Accordingly, the internal space of the water supply portion 430 may be filled with the water flowed out from the delivery flow channel 445. The water supply portion 430 may have a plurality of water discharge holes 435 that are opened downward, and the water remaining in the internal space of the water supply portion 430 may be discharged to the second space 214 of the storage unit 200 through the water discharge holes 435.

In one example, a detergent space connected to the detergent connector 450 may be defined in the internal space of the water supply portion 430. As shown in FIG. 11, detergent discharge holes 436 through which the detergent flowing in the detergent space is discharged to the outside may be defined in a bottom surface of the water supply portion 430.

In the internal space of the water supply portion 430, the detergent space where the detergent flows and the remaining space where water flows may be divided from each other. The water discharge holes 435 defined in a bottom surface of the remaining space and the detergent discharge holes 436 defined in a bottom surface of the detergent space are separated from each other, so that the water and the detergent may be discharged while not being mixed with each other.

In one embodiment of the present disclosure, the shower flow channel 442 may be configured to communicate with the internal space of the water supply portion 430, and may be configured such that the water is delivered from the internal space of the water supply portion 430. However, the internal space of the water supply portion 430 may have the plurality of water discharge holes 435 that are opened downward, and thus, an amount or a pressure of water introduced into the shower flow channel 442 may be reduced, so that sufficient water may not be supplied to the shower portion 440.

Accordingly, in one embodiment of the present disclosure, as the delivery flow channel 445 that flows the water supplied from the water supply flow channel 420 to the shower flow channel 442 is disposed in the water supply portion 430, the amount and the pressure of the water that may be supplied to the shower flow channel 442 and the shower portion 440 may be sufficiently secured.

Furthermore, as at least the portion of the delivery flow channel 445 is opened, the water flowing through the delivery flow channel 445 may be supplied to an entirety of the internal space of the water supply portion 430, so that water discharge uniformity of the water supply portion 430 may be improved.

In one example, referring to FIG. 12, in one embodiment of the present disclosure, in the delivery flow channel 445, the water supplied through the water supply flow channel 420 flows between a pair of flow channel sidewalls 446 crossing the water supply portion 430, and a portion of the pair of flow channel sidewalls 446 may be opened to communicate with the interior of the water supply portion 430.

Specifically, the delivery flow channel 445 may be configured to include the pair of flow channel sidewalls 446. The pair of flow channel sidewalls 446 may be in a shape extending to cross the internal space of the water supply portion 430, and the delivery flow channel 445 may have a space in which the water flows between the pair of flow channel sidewalls 446.

Each of the pair of flow channel sidewalls 446 may be partially opened to define a cut-out 447. The cut-out 447 may be defined by omitting, cutting, or penetrating a portion of the side wall. The interior and the exterior of the delivery flow channel 445 may communicate with each other through the cut-out 447 of the flow channel sidewall 446, and water flowing through the delivery flow channel 445 may be supplied into the water supply portion 430 through the cut-out 447.

A shape of the cut-out 447 may vary, and may include a plurality of cut-outs spaced apart from each other in a longitudinal direction of the delivery flow channel 445. Accordingly, uniformity of the water flowing through the delivery flow channel 445 may be improved in the front and rear direction of the water supply portion 430.

The detergent connectors 450 may be respectively disposed on both sides of the delivery flow channel 445. Accordingly, structural interference between the delivery flow channel 445 and the detergent connector 450 may be prevented. In addition, one embodiment of the present disclosure may have a connector accommodating portion 470 in which the detergent connector 450 is disposed, and each connector accommodating portion 470 may be located on each of both sides of the delivery flow channel 445 in the lateral direction.

The connector accommodating portion 470 may be formed in a shape of a groove recessed from the outer surface of the water supply unit 400 and may be connected to the hose accommodating groove 460. The detergent hose 350, which is seated in and attached to the hose accommodating groove 460, may enter the connector accommodating portion 470 without being spaced apart from the water supply unit 400, and the detergent connector 450 and the detergent hose 350 may be connected to each other without the spacing of the detergent hose 350 as the detergent connector 450 is disposed in the connector accommodating portion 470, so that an amount of protrusion of the detergent connector 450 or the detergent hose 350 from the water supply unit 400 may be reduced.

Furthermore, the detergent connector 450 may include an extending coupling portion extending parallel to a longitudinal direction of the detergent hose 350. As the detergent hose 350 is coupled to the extending coupling portion along the longitudinal direction, the detergent hose 350 may be coupled to the detergent connector 450 in a state of not being bent to be spaced apart from the water supply unit 400, so that the space utilization may be improved.

In one example, in one embodiment of the present disclosure, the shower flow channel 442 may extend from a front end of the water supply portion 430 and be connected to the shower portion 440, and the delivery flow channel 445 may extend forward from the water supply flow channel 420.

Referring to FIG. 12, in one embodiment of the present disclosure, the shower flow channel 442 may extend from the front end of the water supply portion 430. Accordingly, it is possible to suppress an unnecessary increase in a length of the shower flow channel 442 that connects the shower portion 440, at least a portion of which is disposed forwardly of the water supply portion 430, and the water supply portion 430 to each other.

In one example, the delivery flow channel 445 may extend forward from the water supply flow channel 420 at the location inside the water supply portion 430. As described above, in one embodiment of the present disclosure, the water supply connector 410 and the water supply flow channel 420 may be located at the rear of the water supply portion 430, and thus, the delivery flow channel 445 may have a shape extending forwardly at the location inside the water supply portion 430.

Accordingly, even when the shower flow channel 442 is located far from the water supply flow channel 420, water having a sufficient amount and water pressure may be supplied toward the shower flow channel 442 by the delivery flow channel 445, which may be advantageous for the operation of the shower portion 440.

In one example, in one embodiment of the present disclosure, at least a portion of the shower flow channel 442 may extend from the front end of the water supply portion 430 in a width direction of the water supply unit 400. In addition, the water supply unit 400 may be located above the storage unit 200, and the shower portion 440 may be disposed at at least one of both ends of the water supply unit 400 in the lateral direction to discharge the water downward while avoiding the storage unit 200.

Specifically, in one embodiment of the present disclosure, the water supply portion 430 may be disposed above the storage unit 200 to discharge the water downward. Accordingly, the water supply portion 430 may be located above the second space 214 of the storage unit 200 to discharge the water to the second space 214, and the shower portion 440 may be located above the supply casing 300 while avoiding the storage unit 200 to discharge the water into the supply casing 300.

In one embodiment of the present disclosure, the shower portion 440 may be disposed in at least one of both portions of the water supply unit 400 in the lateral direction such that it is easy for the shower portion 440 to discharge the water while avoiding the storage unit 200. FIG. 12 shows a state in which each shower portion 440 is disposed at each of the both ends of the water supply unit 400 in the lateral direction, according to an embodiment of the present disclosure.

The detergent feeder 100 may be configured such that the storage unit 200 is not located below the shower portion 440. For example, the storage unit 200 may be configured to have a shape in which a width thereof is reduced at a position corresponding to the shower portion 440, so that the water discharged from the shower portion 440 may be supplied to the supply casing 300.

In addition, the supply casing 300 may be configured such that a width thereof is increased at a position corresponding to the shower portion 440 to allow the side walls 302 and the storage unit 200 to be spaced apart from each other, so that the water of the shower portion 440 may be supplied into the supply casing 300 while avoiding the storage unit 200.

In addition, the supply casing 300 may be configured such that, as the above-described shower water flow groove 305 is defined in the side wall 302, the water of the shower portion 440 may be supplied to a space defined by the shower water flow groove 305.

In one example, shower portion 440 may be located forwardly of the water supply portion 430 or the detergent discharge portion 220 to wash the front portion of the bottom surface 301 of the supply casing 300. Accordingly, the shower flow channel 442 may extend along the width direction of the water supply unit 400 from the front end of the water supply portion 430 and may be connected to the shower portion 440.

In one example, in one embodiment of the present disclosure, the supply casing 300 may include the bottom surface 301 and the side walls 302 respectively located on the both sides of the bottom surface 301, and each side wall 302 may include the shower water flow groove.

The shower water flow groove 305 may be located below the shower portion 440, and may be opened toward the shower portion 440, so that the water discharged from the shower portion 440 may flow in the shower water flow groove 305. FIG. 8 shows the shower water flow groove 305 viewed from above, and FIG. 9 shows the shower water flow groove 305 defined in the side wall 302.

At least a portion of the shower water flow groove 305 may be located below the shower portion 440. In addition, the portion of the shower water flow groove 305 positioned below the shower portion 440 may be opened upward. Accordingly, the water falling from the shower portion 440 may be introduced into the shower water flow groove 305.

When the shower water falls to the side walls 302 or the bottom surface 301 of the supply casing 300 as it is, an area of the inner surface of the supply casing 300 washed by the shower water may be limited. Therefore, there may be a region that is not able to be washed by the shower water.

When an area of the shower portion 440 is increased to compensate for this, an efficiency may be low in consideration of the water pressure or the amount of water, and the structure may be complicated.

Accordingly, in one embodiment of the present disclosure, the shower water flow groove 305 may be defined in the inner surface of the supply casing 300, and the flow of the shower water supplied from the shower portion 440 may be guided through the shower water flow groove 305, thereby greatly improving a washing area.

The shower water flow groove 305 may have a shape of a groove recessed from the inner surface of the supply casing 300, and may have a shape extending from the side wall 302 to the bottom surface 301. A guide rib or the like for guiding a flow direction of the shower water supplied from the shower portion 440 may be further disposed on the bottom surface 301 of the supply casing 300 together with the shower water flow groove 305.

Figure 13:
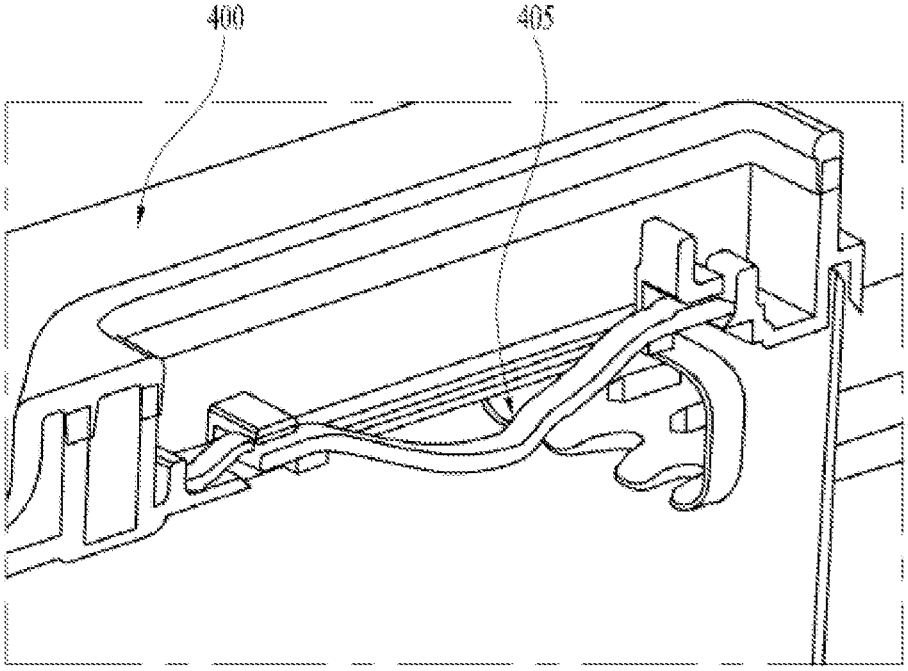
FIG. 13 is a view showing a fastening elastic protrusion in a detergent feeder of a laundry treating apparatus according to an embodiment of the present disclosure.
Figure 14:
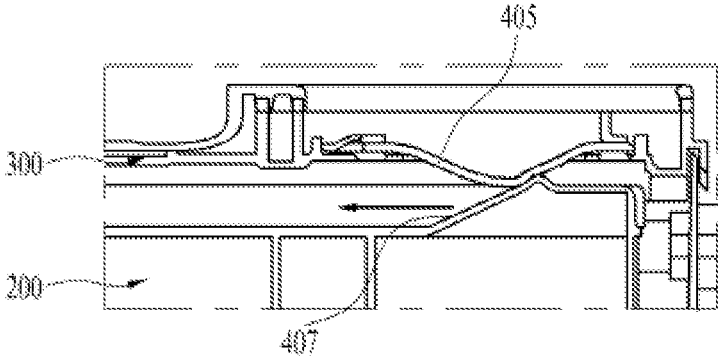
FIG. 14 is a view showing a contact relationship between a fastening elastic protrusion and a fastening protrusion in a detergent feeder of a laundry treating apparatus according to an embodiment of the present disclosure.

In one example, FIG. 13 shows the fastening elastic protrusion 405 according to an embodiment of the present disclosure, and FIG. 14 shows an operation relationship of a fastening protrusion 407 and the fastening elastic protrusion 405.

Referring to FIGS. 13 and 14, in one embodiment of the present disclosure, the water supply unit 400 may further include the fastening elastic protrusion 405, and the fastening elastic protrusion 405 may protrude from one surface thereof facing the storage unit 200 toward the storage unit 200, and may be elastically deformed and restored by the storage unit 200 in the process of insertion and withdrawal of the storage unit 200. In addition, the fastening elastic protrusion 405 may be located between the water supply flow channel 420 and the detergent hose 350.

The fastening elastic protrusion 405 may be disposed on the water supply unit 400 and protrude towards the storage unit 200. The water supply unit 400 may be located above the storage unit 200, and the fastening elastic protrusion 405 may be configured such that at least a portion thereof protrudes downwardly from the water supply unit 400.

FIG. 13 shows the fastening elastic protrusion 405 in a form of penetrating the water supply unit 400 in the vertical direction according to an embodiment of the present disclosure. The fastening elastic protrusion 405 may be formed in a shape in which a strip-shaped member having elasticity is curved to protrude downward.

Both ends in the front and rear direction of the fastening elastic protrusion 405 may be coupled to the water supply unit 400, and at least one of the both ends may be slidably coupled to the water supply unit 400.

The fastening elastic protrusion 405 may be configured so as to be elastically deformed and restored in the process of insertion and withdrawal of the storage unit 200. For example, as shown in FIG. 14, the fastening protrusion 407 protruding upward may be formed on the storage frame of the storage unit 200, and the fastening elastic protrusion 405 may be pressed by the fastening protrusion 407 and elastically deformed and restored again in the process of insertion and withdrawal of the storage unit 200.

Specifically, as shown in FIG. 14, in the storage unit 200 fully inserted into the cabinet 10, the fastening protrusion 407 may be positioned at the rear of the fastening elastic protrusion 405. The fastening protrusion 407 and the fastening elastic protrusion 405 may be disposed to at least partially overlap each other in the front and rear direction.

When the storage unit 200 in the fully inserted state is extended as shown in FIG. 14, the fastening protrusion 407 moves forward while pressurizing and deforming the fastening elastic protrusion 405. In the process of elastic deformation of the fastening elastic protrusion 405, the user may feel resistance by the fastening elastic protrusion 405. Therefore, the user may sensuously identify the withdrawal process of the storage unit 200 by the fastening elastic protrusion 405.

In one example, when the storage unit 200 in the state of being withdrawn out of the cabinet 10 is inserted into the cabinet 10, the fastening protrusion 407 may rearwardly pressurize and deform the fastening elastic protrusion 405, and the user may recognize the resistance by the fastening elastic protrusion 405 during the insertion process of the storage unit 200.

Therefore, the user may sensuously identify a degree of insertion of the storage unit 200 through the resistance of the fastening elastic protrusion 405 during the insertion process of the storage unit 200, thereby improving the usability.

Furthermore, a restoring force of the fastening elastic protrusion 405 may be transmitted to the fastening protrusion 407 to induce the movement of the storage unit 200. For example, in the insertion process of the storage unit 200, the restoring force of the fastening elastic protrusion 405 may help the insertion of the storage unit 200. In addition, in the withdrawal process of the storage unit 200, the restoring force of the fastening elastic protrusion 405 may help the withdrawal of the storage unit 200.

Accordingly, the user may feel the movement of the storage unit 200 by the restoring force of the fastening elastic protrusion 405 after directly moving the storage unit 200 over a certain level in the process of insertion and withdrawal of the storage unit 200, so that the usability may be improved.

Although the present disclosure has been illustrated and described in relation to a specific embodiment, within the limits that do not depart from the technical spirit of the present disclosure provided by the following claims, it will be apparent to those of ordinary skill in the art that the present disclosure may be variously improved and changed.

What is claimed is:

1. A laundry treating apparatus comprising:

a cabinet that defines a detergent opening at a front surface thereof;

a tub disposed inside the cabinet;

a drum rotatably disposed inside the tub and configured to receive laundry; and a detergent feeder disposed inside the cabinet and configured to supply detergent into the tub, wherein the detergent feeder comprises:

a detergent storage that defines a storage space configured to store the detergent, the detergent storage being configured to be inserted into and withdrawn from the cabinet through the detergent opening, a supply casing that accommodates the detergent storage, and a water supply configured to supply water to at least one of the detergent storage or the supply casing, wherein the water supply comprises:

a water supply portion configured to supply water to the detergent storage, a shower portion configured to supply water into an area of the supply casing outside the detergent storage, and a shower flow channel that extends from the water supply portion and connects to the shower portion, the shower flow channel being configured to deliver water from the water supply portion to the shower portion, and wherein the shower portion protrudes outward from an exterior surface of the water supply in a lateral direction relative to a sidewall of the detergent storage and defines a portion of the exterior surface of the water supply.

2. The laundry treating apparatus of claim 1, wherein the detergent storage comprises a detergent discharge portion configured to discharge the detergent and the water supplied to the detergent storage through the water supply portion, and wherein at least a portion of the shower portion is located forward relative to the detergent discharge portion and configured to supply water to a region of the supply casing located forward relative to the detergent discharge portion.

3. The laundry treating apparatus of claim 1, wherein at least a portion of the shower portion is located forward relative to the water supply portion and configured to discharge water to a region located forward relative to the water supply portion.

4. The laundry treating apparatus of claim 1, wherein the water supply further comprises a water supply flow channel connected to the water supply portion and configured to guide water toward the water supply portion, wherein the water supply portion comprises a delivery flow channel that extends from the water supply flow channel toward the shower flow channel, and wherein the delivery flow channel comprises one or more openings that are opened toward an interior of the water supply portion and configured to supply, into the water supply portion, the water delivered from the water supply flow channel through the delivery flow channel.

5. The laundry treating apparatus of claim 4, wherein the water supply further comprises a pair of flow channel sidewalls that define the delivery flow channel therebetween, and wherein a portion of the pair of flow channel sidewalls defines the one or more openings that are in fluid communication with the interior of the water supply portion.

6. The laundry treating apparatus of claim 4, wherein the delivery flow channel extends forward from the water supply flow channel, and wherein the shower flow channel extends from a front end of the water supply portion and is connected to the shower portion.

7. The laundry treating apparatus of claim 6, wherein at least a portion of the shower flow channel extends from the front end of the water supply portion along a width direction of the water supply.

8. The laundry treating apparatus of claim 1, further comprising a water supply valve configured to regulate supply of water to the water supply.

9. The laundry treating apparatus of claim 8, further comprising a water supply hose connected to the water supply valve and configured to supply the water to the water supply based on control of the water supply valve, wherein the water supply further comprises an internal water supply flow channel configured to guide the water from the water supply hose to the water supply portion, and wherein the water supply portion is configured to receive the water through the internal water supply flow channel and to provide the water to the shower portion through the shower flow channel.

10. The laundry treating apparatus of claim 1, wherein the water supply is located above the detergent storage, wherein the shower portion is disposed at a lateral end of the water supply and configured to discharge water downward to the area of the supply casing outside the detergent storage, wherein the supply casing comprises a bottom surface and side walls, the side walls being located at lateral sides of the bottom surface, and wherein each of the side walls defines a shower water flow groove below the shower portion, the shower water flow groove being open toward the shower portion and configured to receive a part of the water discharged from the shower portion.

11. The laundry treating apparatus of claim 1, further comprising a detergent hose configured to supply a first detergent to the water supply, wherein the storage space of the detergent storage includes a first space configured to store the first detergent and a second space configured to store a second detergent, and wherein the water supply is configured to supply the first detergent and water to the second space through the water supply portion.

12. A laundry treating apparatus comprising:

a cabinet that defines a detergent opening at a front surface thereof;

a tub disposed inside the cabinet;

a drum rotatably disposed inside the tub and configured to receive laundry; and a detergent feeder disposed inside the cabinet and configured to supply detergent into the tub, wherein the detergent feeder comprises:

a detergent storage that defines a storage space configured to store the detergent, the detergent storage being configured to be inserted into and withdrawn from the cabinet through the detergent opening, a supply casing that accommodates the detergent storage, and a water supply configured to supply water to at least one of the detergent storage or the supply casing, wherein the water supply comprises:

a water supply portion configured to supply water to the detergent storage, a shower portion configured to supply water into an area of the supply casing outside the detergent storage, and a shower flow channel that extends from the water supply portion and connects to the shower portion, the shower flow channel being configured to deliver water from the water supply portion to the shower portion, wherein the shower portion protrudes in a lateral direction of the water supply, wherein the laundry treating apparatus further comprises a detergent hose configured to supply a first detergent to the water supply, wherein the storage space of the detergent storage includes a first space configured to store the first detergent and a second space configured to store a second detergent, wherein the water supply is configured to supply the first detergent and water to the second space through the water supply portion, wherein at least a portion of the detergent hose extends along an outer surface of the water supply, and wherein the water supply has a hose accommodating groove that is defined at the outer surface of the water supply, that extends along a longitudinal direction of the detergent hose, and that accommodates at least the portion of the detergent hose.

13. The laundry treating apparatus of claim 12, further comprising a water supply hose that is configured to supply the water to the water supply, wherein the detergent hose comprises a pair of detergent hoses, and wherein the water supply comprises a water supply flow channel connected to the water supply hose and to the water supply portion, the water supply flow channel being located between the pair of detergent hoses.

14. The laundry treating apparatus of claim 13, wherein the water supply further comprises a fastening elastic protrusion that protrudes toward the detergent storage and is configured to deform from a first shape based on the detergent storage being inserted into and withdrawn from the cabinet, and wherein the fastening elastic protrusion is located between the water supply flow channel and one of the pair of detergent hoses.

15. The laundry treating apparatus of claim 14, wherein the fastening elastic protrusion is configured to restore the first shape based on the detergent storage being inserted into and withdrawn from the cabinet.

16. The laundry treating apparatus of claim 15, wherein the water supply portion is configured to carry water and to provide the water to the shower portion through the shower flow channel.

17. A laundry treating apparatus comprising:

a cabinet;

a tub disposed inside the cabinet;

a drum rotatably disposed inside the tub and configured to receive laundry; and a detergent feeder disposed inside the cabinet and configured to supply detergent into the drum, wherein the detergent feeder comprises:

a detergent storage that defines a storage space configured to store the detergent, a supply casing that accommodates the detergent storage, and a water supply configured to supply water to at least one of the detergent storage or the supply casing, wherein the water supply comprises:

a water supply portion configured to supply water to the detergent storage, and a shower portion configured to receive water from the water supply portion and to supply the water from the water supply portion into an area of the supply casing outside the detergent storage, and wherein the shower portion protrudes outward from an exterior surface of the water supply in a lateral direction relative to a sidewall of the detergent storage and defines a portion of the exterior surface of the water supply.

18. The laundry treating apparatus of claim 17, wherein the water supply portion is configured to carry water and to provide the water to the shower portion.

19. The laundry treating apparatus of claim 17, wherein the water supply portion extends in a first direction, and wherein the water supply comprises further comprises a shower flow channel that extends from an end of the water supply portion in a second direction different from the first direction, the shower flow channel connecting the water supply portion to the shower portion.

20. The laundry treating apparatus of claim 1, wherein the shower portion is one of a plurality of shower portions that are respectively disposed at both sides of the water supply spaced apart from each other in a lateral direction, and wherein a lateral width of the supply casing between the plurality of shower portions is greater than a lateral width of another portion of the supply casing in the lateral direction.

* * * * *